US009056491B2

(12) United States Patent
Bitoh

(10) Patent No.: US 9,056,491 B2
(45) Date of Patent: Jun. 16, 2015

(54) NAIL PRINT APPARATUS

(71) Applicant: CASIO COMPUTER CO., LTD., Shibuya-ku, Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/185,767

(22) Filed: Feb. 20, 2014

(65) Prior Publication Data

US 2014/0232802 A1 Aug. 21, 2014

(30) Foreign Application Priority Data

Feb. 21, 2013 (JP) ..... 2013-031642

(51) Int. Cl.

| | |
|---|---|
| ***B41J 2/00*** | (2006.01) |
| ***B41J 2/49*** | (2006.01) |
| ***B41J 3/407*** | (2006.01) |
| ***B41J 25/308*** | (2006.01) |
| *A45D 29/00* | (2006.01) |

(52) U.S. Cl.

CPC *B41J 2/49* (2013.01); *B41J 3/4073* (2013.01); *B41J 25/308* (2013.01); *A45D 2029/005* (2013.01)

(58) Field of Classification Search

USPC ..... 347/110

See application file for complete search history.

(56) References Cited

U.S. PATENT DOCUMENTS

| | | | | |
|---|---|---|---|---|
| 3,550,276 | A * | 12/1970 | Kramer et al. | 33/18.1 |
| 4,299,031 | A * | 11/1981 | Collins et al. | 33/18.1 |
| 4,673,954 | A * | 6/1987 | Sakai | 346/139 R |
| 5,931,166 | A * | 8/1999 | Weber et al. | 132/73 |
| 6,286,517 | B1 | 9/2001 | Weber et al. | |
| 8,061,365 | B2 * | 11/2011 | Rehkemper et al. | 132/73.6 |
| 8,814,291 | B2 * | 8/2014 | Bitoh | 347/5 |

FOREIGN PATENT DOCUMENTS

JP 2003-534083 A 11/2003

* cited by examiner

*Primary Examiner* — Jannelle M Lebron
*Assistant Examiner* — Jeremy Bishop
(74) *Attorney, Agent, or Firm* — Holtz, Holtz, Goodman & Chick PC

(57) ABSTRACT

A nail print apparatus, including: a placement surface on which a drawing target is placed, the drawing target has a curved shape along a width direction of the drawing target; a drawing head in which at least one drawing tool is set, the drawing tool having a tip portion that contacts with a surface of the drawing target and performs drawing on the surface of the drawing target; and a head drive unit which moves the drawing head along the placement surface.

14 Claims, 18 Drawing Sheets

NAIL PRINT APPARATUS

CROSS-REFERENCE TO RELATED APPLICATIONS

The entire disclosure of Japanese Patent Application No. 2013-031642 filed on Feb. 21, 2013 including description, claims, drawings, and abstract are incorporated herein by reference in its entirety.

BACKGROUND OF THE INVENTION

1. Field of the Invention

The present invention relates to a nail print apparatus.

2. Description of Related Art

Nail print apparatuses are print apparatuses which print design images such as colors and pictures on a nail of a finger.

Among such nail print apparatuses, a nail print apparatus which includes a print head performing printing in the inkjet system and prints design images such as colors and pictures on a nail of a finger is described in Japanese Unexamined Patent Application Publication No. 2003-534083, for example.

A print head of the inkjet system performs printing by ejecting ink from a nozzles facing a printing target surface, and landing and fixing the ink on a printing target surface.

However, in the ink-jet type print head, the nozzle would be clogged with ink of a color material which has a large particle diameter and the color material would be precipitated since the nozzle hole diameter is small, and thus only the ink which includes a color material of a small particle diameter can be used.

Thus, gold, silver and white ink using the color material of small particle diameter has a limitation in printable nail design such that the color is not produced well and nail designs with lame cannot be achieved, for example.

In the ink-jet type print head, it is difficult to eject viscous ink, and thus, the viscous ink cannot be used. Thus, the nail print apparatus using the ink-jet type print head has a problem that the color is light and dull, and there is no thickness feeling and the finish does not have the high-class look.

Furthermore, in the ink-jet system, the original color of ink cannot be sufficiently produced unless white color is applied as a base since the ink-jet system is originally intended for printing on a white background such as a sheet of paper. Thus, it is impossible to print designs utilizing clear nails.

As described above, since the ink-jet type print head cannot use ink which includes a color material of relatively large particle diameter such as white color, the user needs to apply the white color as the base with his/her own hands. Thus, in addition to troublesome work, there is also a problem that the finish cannot be beautiful due to running off of the base ground, uncoated area, color unevenness which is left even after printing and such like.

SUMMARY OF THE INVENTION

An object of the present invention is to provide a nail print apparatus which can achieve nail prints that are varied and have beautiful finishes similar to nail prints applied at nail salons.

In order to solve the above object, according to one aspect of the present invention, there is provided a nail print apparatus, including: a placement surface on which a drawing target is placed, the drawing target having a curved shape along a width direction of the drawing target; a drawing head in which at least one drawing tool is set, the drawing tool having a tip portion that contacts with a surface of the drawing target and performs drawing on the surface of the drawing target; and a head drive unit which moves the drawing head along the placement surface, wherein the head drive unit is controlled to move the drawing tool via the drawing head when performing the drawing, and the drawing tool is movable in accordance with the curved shape of the drawing target when performing the drawing.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Figure 1:
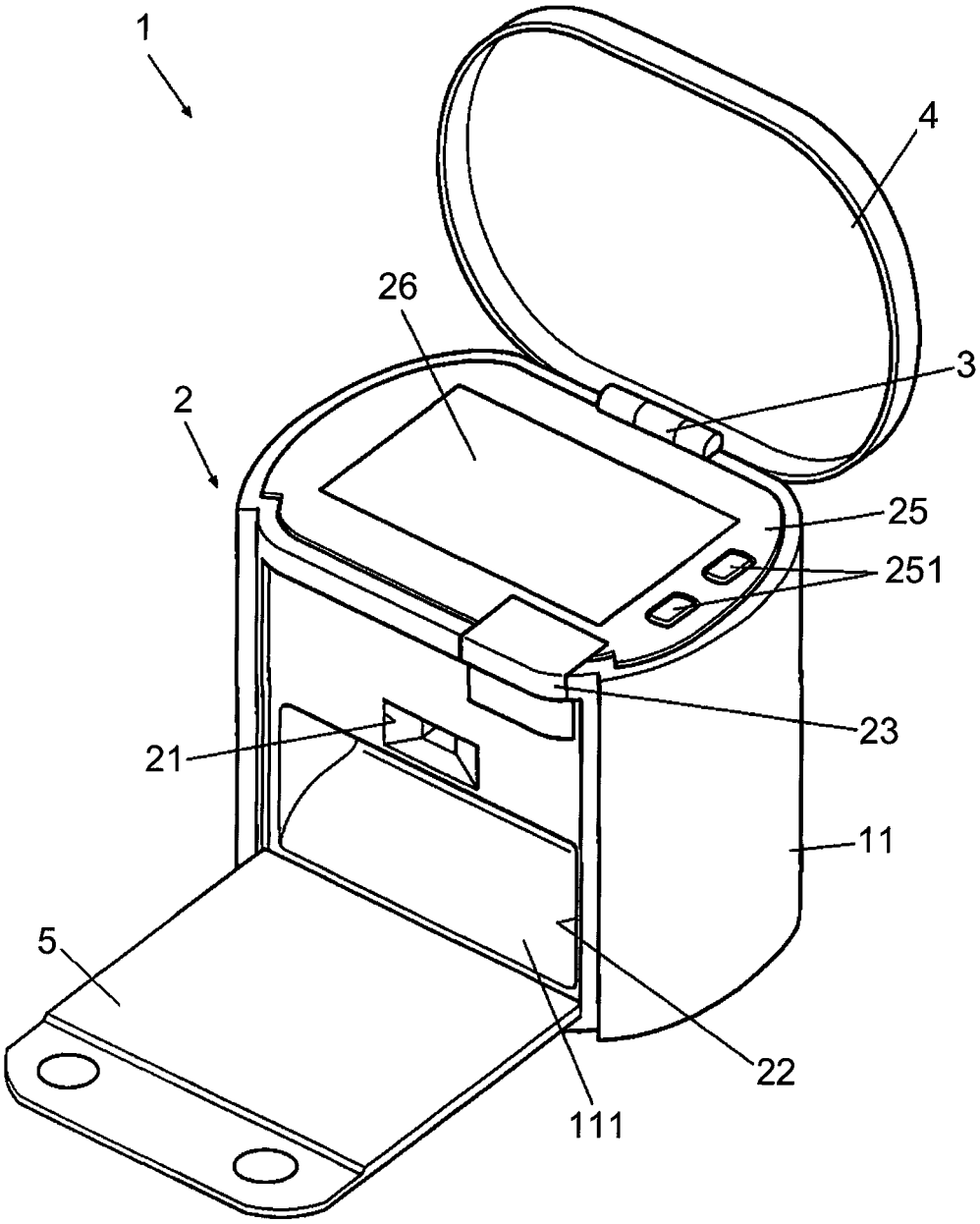
FIG. 1 is a perspective view conceptually showing a nail print apparatus in a first embodiment, which shows a state where a cover is open.

Hereinafter, nail print apparatuses according to the present invention will be described in detail by showing embodiments.

[First Embodiment]

With reference to FIGS. 1 to 11I, the first embodiment of the nail print apparatus 1 according to the present invention will be described.

Though the after-mentioned embodiment is provided with various technically preferred limitations to perform the present invention, the scope of the present invention is not limited to the following embodiment and illustrated examples.

In the following embodiment, the nail print apparatus 1 performs drawing on a nail of a finger as a drawing target. However, the drawing target of the present invention is not limited to the nail of finger. The drawing target may be a nail of a toe.

FIG. 1 is a perspective view showing an outer appearance of the nail print apparatus 1 in the embodiment.

Figure 2:
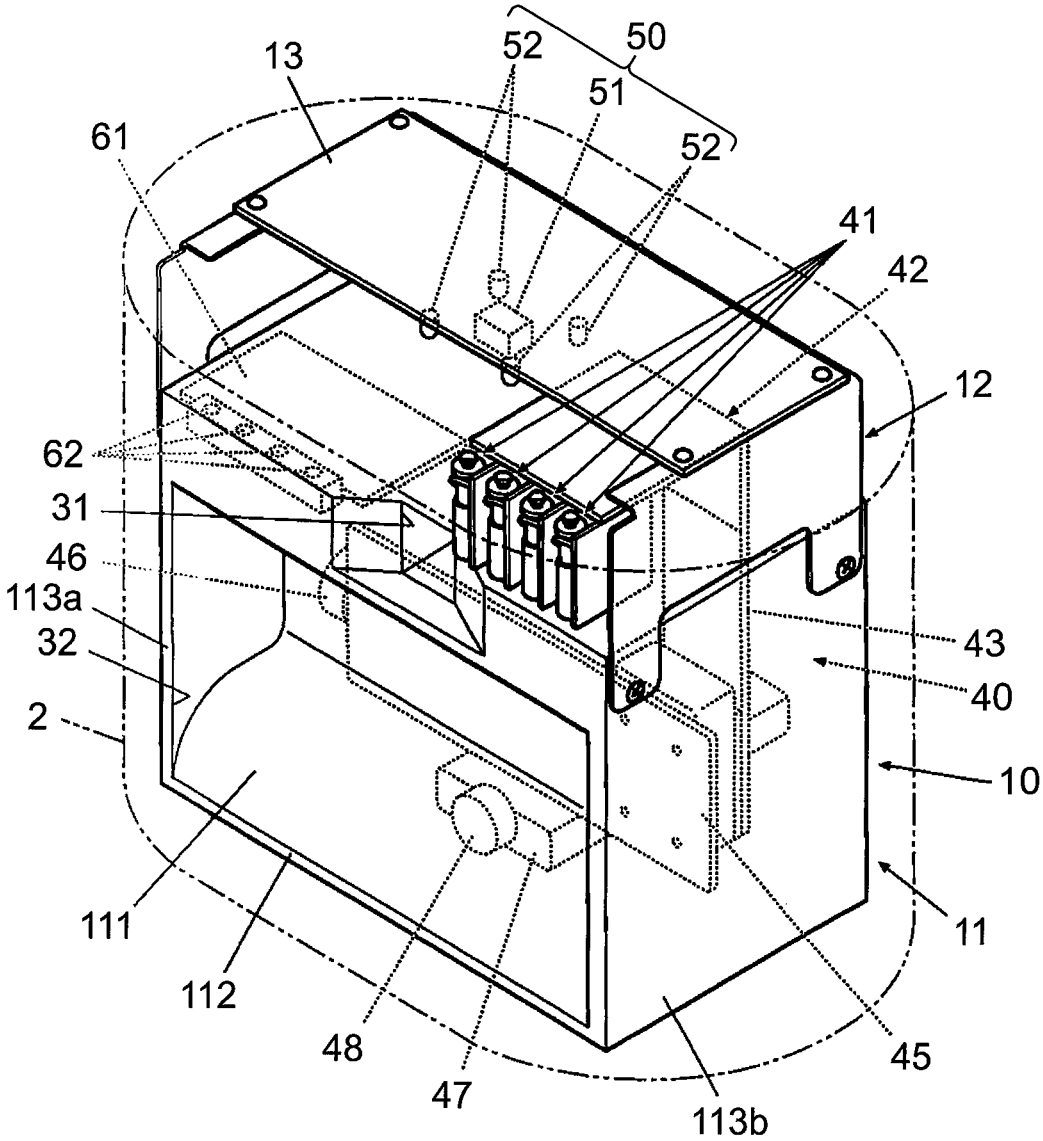
FIG. 2 is a perspective view conceptually showing an apparatus main body of the nail print apparatus of FIG. 1.

FIG. 2 is a perspective view showing an internal configuration of the nail print apparatus 1.

As shown in FIG. 1, the nail print apparatus 1 includes a case main body 2 and a cover 4.

The cover 4 is connected to the case main body 2 so as to be rotatable via a hinge 3 provided at a rear end portion on the upper surface (top plate) of the case main body 2.

The cover 4 is rotatable from a state of lying on the top plate of the case main body 2 to a state (see FIG. 1) of being vertically provided with respect to the top plate of the case main body 2 with the hinge 3 as the supporting point.

The case main body 2 is formed in a nearly oval shape in a plan view from above.

An opening/closing plate 5 is provided at the front side of the case main body 2 so as to be able to flip up and down.

The opening/closing plate 5 is joined to the case main body 2 via a hinge (not shown in the drawings) which is provided at the lower end portion of the front surface of the case main body 2. The opening/closing plate 5 is for opening and closing the front surface of the case main body 2.

The shapes and configurations of the case main body 2 and the cover 4 are not limited to the example illustrated here.

As shown in FIGS. 1 and 2, a printing finger inserting port 21 to insert a finger (hereinafter, called "printing finger U1") corresponding to a nail T which is a target of drawing is formed at a nearly central portion of the front surface of the case main body 2.

The printing finger inserting port 21 is an inserting port leading to an after-mentioned finger receiving unit 31.

A non-printing finger inserting port 22 to insert fingers (hereinafter, called "non-printing fingers U2") corresponding to nails T (that is, a nail T waiting for drawing and a nail T for which drawing is finished and such like) which are not targets of drawing are formed below the printing finger inserting port 21 on the front surface of the case main body 2.

The non-printing finger inserting port 22 is an inserting port leading to an after-mentioned finger resting unit 32.

At an end of the upper portion of the front surface of the case main body 2, a pen replacement cover 23 is provided so as to be able to open and close for replacing a pen (drawing tool) 41 of an after-mentioned drawing unit 40.

Figure 4:
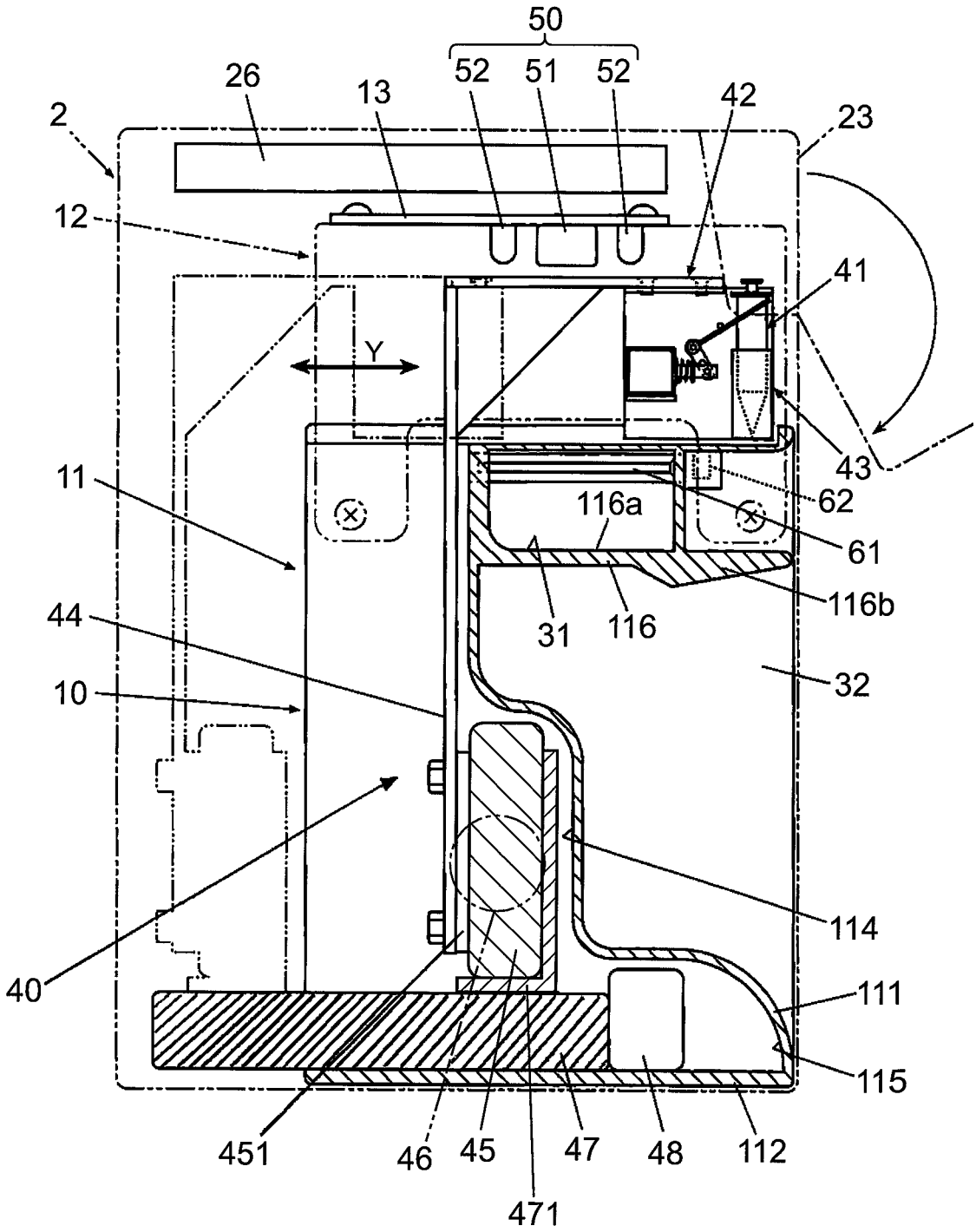
FIG. 4 is a sectional view of FIG. 3 cut along the line IV-IV.

The pen replacement cover 23 freely rotates from a closed state to an open state as shown in after-mentioned FIG. 4 via a hinge, for example.

Furthermore, a medium inserting port 24 (see FIG. 3) through which a drawing medium 61*a* to be placed on an after-mentioned pen test writing unit 61 can be replaced is formed at a position corresponding to the pen test writing unit 61 on a lateral surface (in the embodiment, the left side surface in FIG. 3) of the case main body 2.

An operation unit 25 is set on the upper surface (top plate) of the case main body 2.

The operation unit 25 is an input unit for performing various input by a user.

The operation unit 25 is provided with a power switch button to turn on the nail print apparatus 1, a stop switch button to stop an operation, a design selection button to select a design image to be drawn on a nail T, a drawing start button to instruct the drawing start and operation buttons 251 for performing various types of input, for example.

A display unit 26 is set at a nearly central portion of the upper surface (top plate) of the case main body 2.

The display unit 26 is configured by including a liquid crystal display (LCD: Liquid Crystal Display), an organic electroluminescent display and other flat display, for example.

In the embodiment, on the display unit 26, an image (hereinafter, called "finger image") obtained by photographing a finger U1, a nail image (image such as the outline of a nail T) included in the finger image, a design selection screen for selecting a design image to be drawn on the nail T, thumbnail images for design confirmation, instruction screens for displaying various instructions are appropriately displayed, for example.

A touch panel may be integrally formed on the surface of the display unit 26. In such case, it is configured so that various types of input can be carried out also by a touching operation of touching the surface of the display unit 26 with a stylus pen (not shown in the drawings) which is a writing tool of sharpened stick and write down by being pressed against the touch panel surface and a fingertip, for example.

An apparatus main body 10 of the nail print apparatus 1 is contained in the case main body 2.

Figure 3:
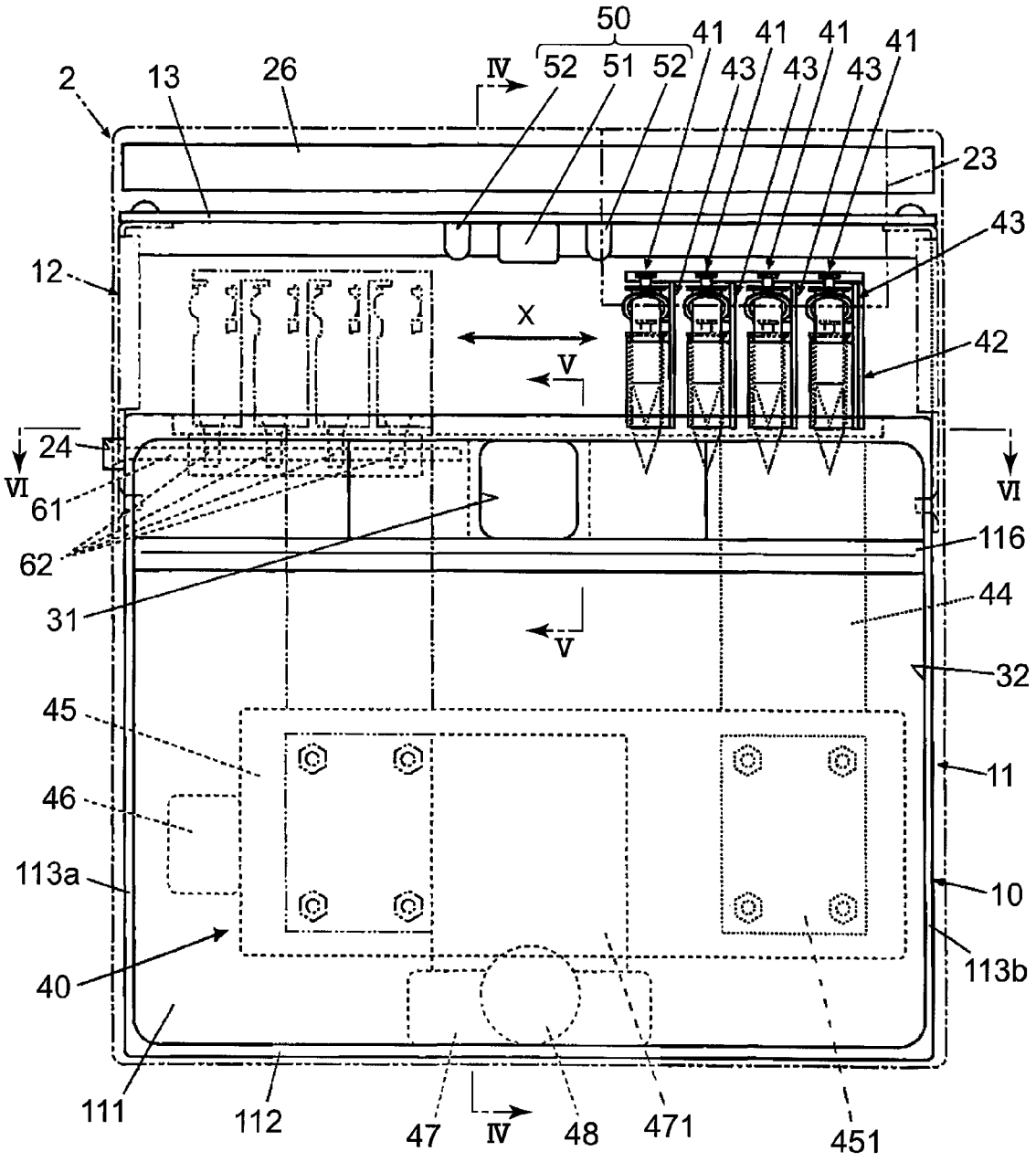
FIG. 3 is a front view of the apparatus main body of the nail print apparatus of FIG. 1.

FIG. 3 is a front view of the apparatus main body in the embodiment.

FIG. 4 is a sectional view showing a cross-section surface cut along the line IV-IV shown in FIG. 3 and seen from the arrow direction.

As shown in FIGS. 2 to 4, the apparatus main body 10 includes a lower machine casing 11 which is formed in a nearly box shape and is set at the lower section in the case main body 2 and an upper machine casing 12 which is set above the lower machine casing 11 and at the upper section in the case main body 2.

First, the lower machine casing 11 will be described.

As shown in FIGS. 3 and 4, the lower machine casing 11 includes a back surface board 111, a bottom board 112, a horizontal pair of side boards 113*a* and 113*b*, an X-direction movement stage containing section 114, a Y-direction movement stage containing section 115 and a dividing wall 116.

The lower ends of the side boards 113*a* and 113*b* are connected to the left and right end portions of the bottom board 112, respectively, and the side boards 113*a* and 113*b* are vertically provided with respect to the bottom board 112.

The lower portion of the back surface board 111 is formed to be concave in two steps toward the front side (front side in the finger inserting direction).

The lower end portion of the back surface board 111 is connected to the front end portion of the bottom board 112, and the back surface board 111 divides an area, which is surrounded by the bottom board 112 and the side boards 113*a* and 113*b*, back and forth.

The X-direction movement stage containing section 114 and the Y-direction movement stage containing section 115 are formed back from the concave back surface board 111 (see FIG. 4).

In the X-direction movement stage containing section 114, an X-direction movement stage 45 of the drawing unit 40 is contained when the drawing unit 40 is moved forward (toward the front side of the finger inserting direction).

A Y-direction movement stage 47 of the drawing unit 40 is disposed in the Y-direction movement stage containing section 115.

The dividing wall 116 is provided inside the lower machine casing 11 so as to vertically divide a space (space at the front side of the finger inserting direction which is surrounded by the back surface board 111, bottom board 112 and the side boards 113*a* and 113*b*) at the front side inside the lower machine casing 11.

The dividing wall 116 is provided to be nearly horizontal, the lateral end portions of the dividing wall 116 are connected to the side boards 113*a* and 113*b*, respectively, and the rear end portion of the dividing wall 116 is connected to the back surface board 111.

A finger fixing unit 30 is integrally provided in the lower machine casing 11.

With reference to FIGS. 3 to 6, the finger fixing unit 30 will be described.

Figure 5:
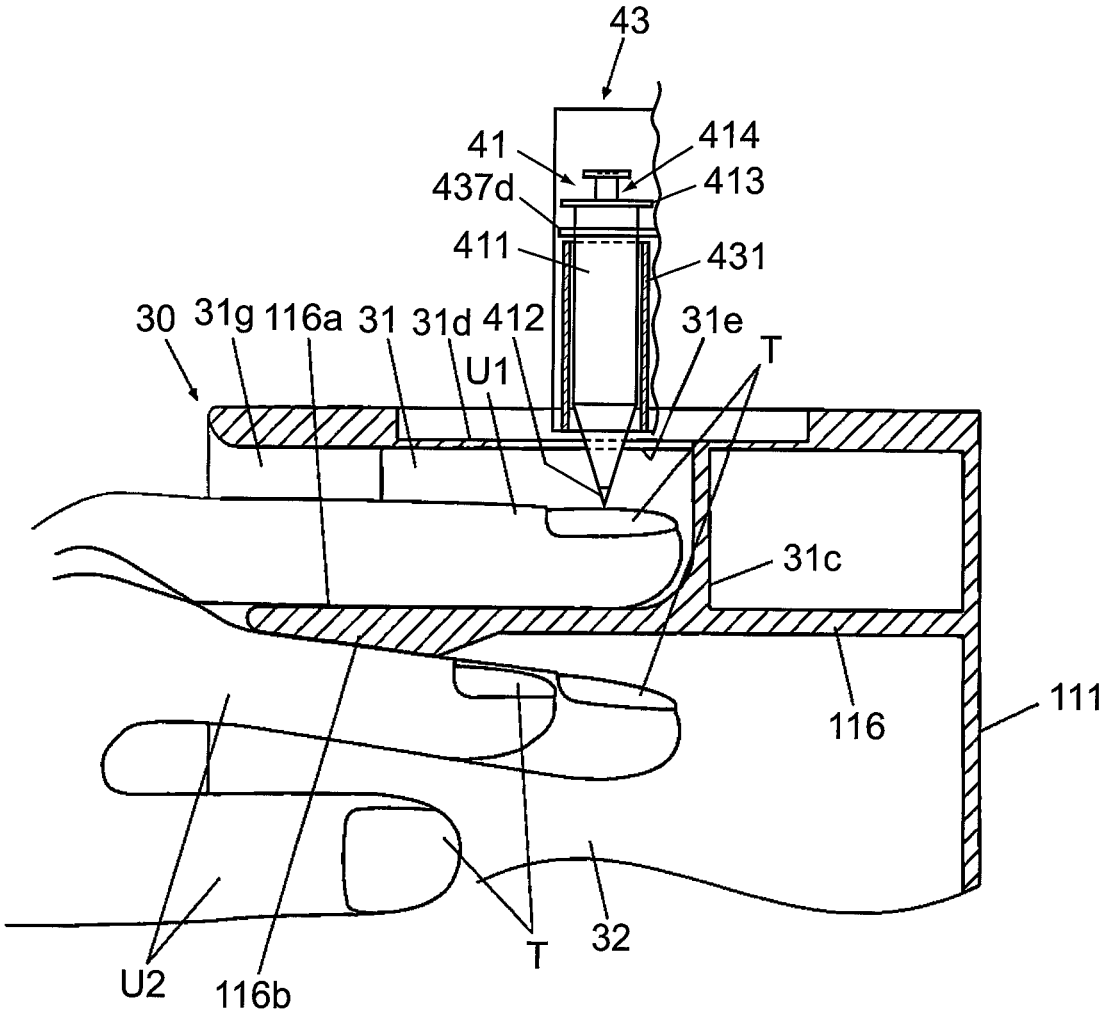
FIG. 5 is a sectional view of FIG. 3 cut along the line V-V.

FIG. 5 is a sectional view showing a cross-section cut along the line V-V shown in FIG. 3 and seen from the arrow direction.

Figure 6:
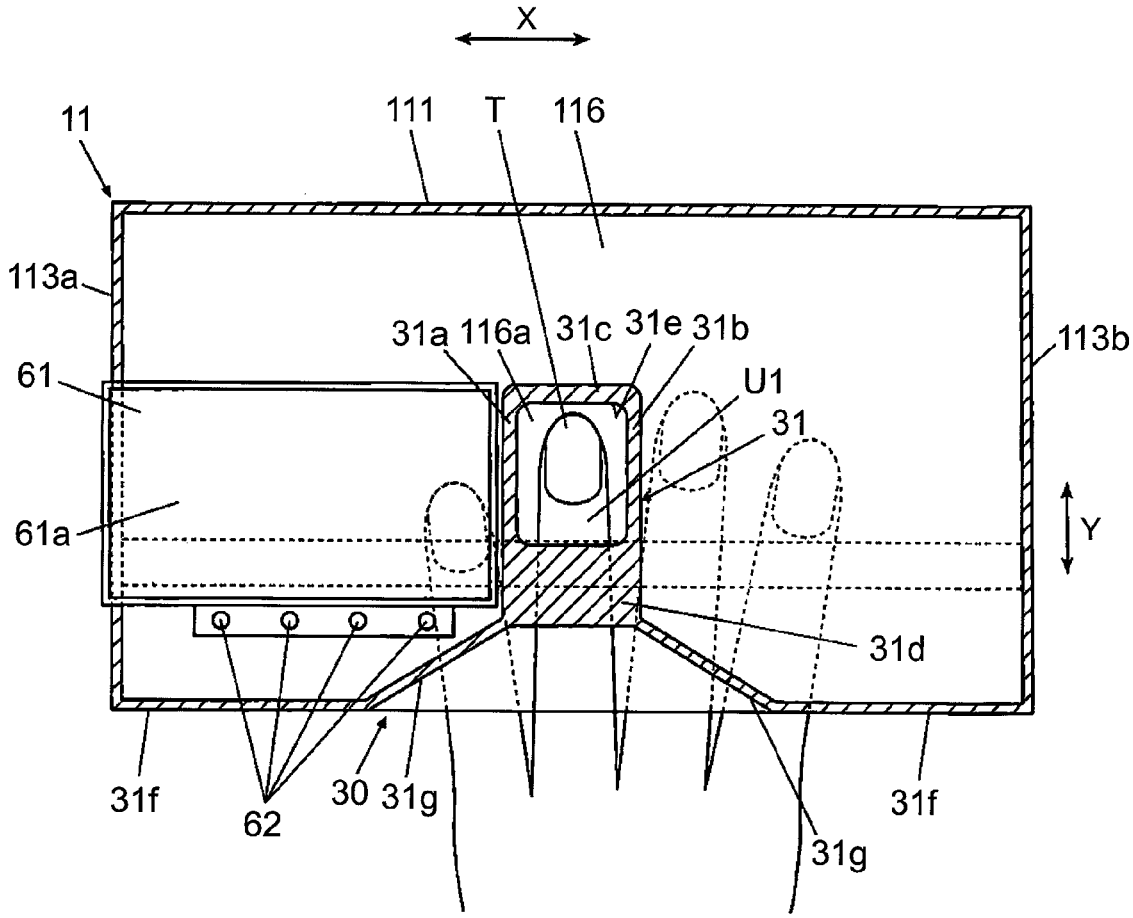
FIG. 6 is a sectional view of FIG. 3 cut along the line VI-VI.

FIG. 6 is a sectional view showing a cross-section cut along the line VI-VI shown in FIG. 3 seen from the arrow direction.

The finger fixing unit 30 is configured by including a finger receiving unit 31 which receives a finger (hereinafter, called "printing finger U1") corresponding to a nail subject to drawing and a finger resting unit 32 on which fingers (hereinafter, called "non-printing fingers U2") other than the printing finger U1 rests.

The finger receiving unit 31 is disposed at a position (nearly in the middle of the width direction of the lower machine casing 11) corresponding to the above-mentioned printing finger inserting port 23 at the upper side of the dividing wall 116.

The space divided by the dividing wall 116 to be lower side of the lower machine casing 11 forms the finger resting unit 32.

For example, in a case where drawing is to be performed on a nail T of a ring finger, as shown in FIG. 5, the ring finger as the printing finger U1 is inserted into the finger receiving unit 31 and the other four fingers (thumb, index finger, middle finger and little finger) which are non-printing fingers U2 are inserted into the finger resting unit 32.

The finger receiving unit 31 is open at the front surface side (front side, the side near the printing finger inserting port 23 of the case main body 2) of the lower machine casing 11, and defined by a finger placement unit 116*a* forming a part of the dividing wall 116 at the lower side, by dividers 31*a* and 31*b* at both lateral sides and by a divider 31*c* at the back side.

The finger placement unit 116*a* is for placing the finger (printing finger U1) of the nail T to perform drawing on the X-Y plane.

The upper side of the finger receiving unit 31 is defined by a roof 31*d*.

A window 31*e* for exposing the nail T of the printing finger U1 inserted into the finger receiving unit 31 is formed in the roof 31*d*.

A front wall 31*f* which covers the front surface side of the lower machine casing 11 is vertically provided at each of the lateral portions of the front surface side of the lower machine casing 11 on the upper surface of the dividing wall 116.

On the upper surface of the dividing wall 116, a pair of guide walls 31*g* is vertically provided, the guide walls 31*g* being narrowing toward the finger receiving unit 31 from the end portions of the front walls 31*f* which are near the central portion and guiding the printing finger U1 into the finger receiving unit 31.

The user can sandwich the dividing wall 116 between the printing finger U1 inserted into the finger receiving unit 31 and the non-printing fingers U2 inserted into the finger resting unit 32. Thus, the printing finger U1 inserted into the finger receiving unit 31 is fixed stably.

In the embodiment, a protrusion 116*b* protruding downward is formed at the front end portion of the dividing wall 116. The protrusion 116*b* is a tapered unit which gradually becomes thinner toward the front side and gradually becomes thicker toward the back side, for example. Alternatively, the entire protrusion 116*b* may be thick with respect to the concave at the back side of the dividing wall 116.

By forming the protrusion 116*b* at the front end portion of the dividing wall 116 in such way, when the non-printing fingers U2 are inserted into the finger resting unit 32, a space is secured between the nails T of the fingers on which drawing is already performed and the dividing wall 116. Thus it is possible to prevent ink from attaching to the apparatus due to the contact of the nails T with the lower surface of the dividing wall 116 and prevent pictures drawn on the nail T from blurring to be damaged.

Next to the finger receiving unit 31 (the position corresponding to the medium inserting port 24 of the case main body 2, and the left side in FIG. 6 in the embodiment) on the upper surface of the dividing wall 116, the pen test writing unit 61 for after-mentioned test writing of a pen 41 is provided within a movable range of an after-mentioned drawing head 42.

It is preferable that the pen test writing unit 61 is provided so as to be nearly as high as the nail T when the printing finger U1 is inserted into the finger receiving unit 31.

The pen test writing unit 61 is a flat plate portion and for placing a drawing medium 61*a* inserted through the medium inserting port 24 of the above-mentioned case main body 2.

The drawing medium 61*a* to be placed on the pen test writing unit 61 may be anything as long as it can condition a pen tip 412, and is a single sheet of paper, for example.

The pen test writing unit 61 is for preventing the blur of ink at the start of drawing due to a dry pen tip 412, poor ink application and such like and for improving the condition of the pen tip 412 by lowering the pen 41 onto the drawing medium 61*a* and drawing a predetermined image such as "o" and "∞" to perform test writing before starting the drawing by image data on the nail T.

Though the predetermined image to be drawn at test writing is not especially limited, a preferable one is a simple figure such as "o" and "∞" so as not to waste too much ink. It is preferable to draw the figure such as "o" and "∞" at different positions within the range of the pen test writing unit 61 every time the test writing is performed.

When the test writing is performed on the nearly entire surface of the drawing medium 61*a*, a display screen such as "replace sheet" which requires replacement of the drawing medium 61*a* is displayed on the display unit 26. In such case, by the user removing the drawing medium 61*a* from the medium inserting port 24 to replace it with a new one, test writing becomes possible on the new drawing medium 61*a*.

In a case where the drawing medium 61*a* is a roll of paper, when there is no drawing space left, the roll of paper is wheeled to feed a drawing medium 61*a* and test writing becomes possible on a new drawing surface.

In the embodiment, pen caps 62 made of rubber are set in front (front side of the finger inserting direction, lower side in FIG. 6) of the pen test writing unit 61.

The number of the provided pen caps 62 (four in the embodiment) corresponds to the pens 41 set in the drawing unit 40. After setting the pens 41 in the drawing unit 40 and when drawing is not performed, the pens 41 are moved toward directly above the pen caps 62, and thereafter the pens 41 are lowered by after-mentioned solenoids 435 being pulled and the pen tips 412 are contained in the pen caps 62. Thereby, the pen tips 412 can be prevented from drying when drawing is not performed The shapes and such like of the pen caps 62 are not limited to the illustrated example. For example, the pen caps 62 may be a long groove-like pen cap which can receive the pen tips 412 of all the pens 41 set in the drawing unit 40.

In the embodiment, since the pen caps 62 are provided near the pen test writing unit 61 in such way, drawing can be started by elevating a pen 41 to perform test writing in the pen test writing unit 61 which is close to the pen caps 62. Thus, it is possible to minimize the time required for moving the pen 41 and such like and perform the drawing operation rapidly.

The drawing unit 40 is configured by including the drawing head 42 which includes the pens (drawing tools) 41 for drawing, a unit supporting member 44 which supports the drawing head 42, the X-direction movement stage 45 for moving the drawing head 42 in the X direction (X direction in FIGS. 3 and 6, lateral direction of the nail print apparatus 1), an X-direction movement motor 46, the Y-direction movement stage 47 for moving the drawing head 42 in the Y direction (Y direction in FIGS. 4 and 6, front-back direction of the nail print apparatus 1), a Y-direction movement motor 48 and such like.

In the embodiment, the drawing head 42 includes four pen carriages 43 each of which holds one of the pens 41.

Figure 7B:
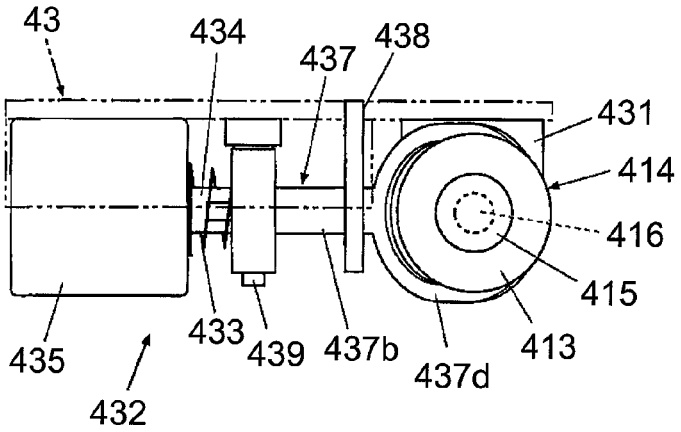
FIG. 7B is a top view of the pen carriage and the pen of FIG. 7A seen from the arrow b direction.
Figure 7A:
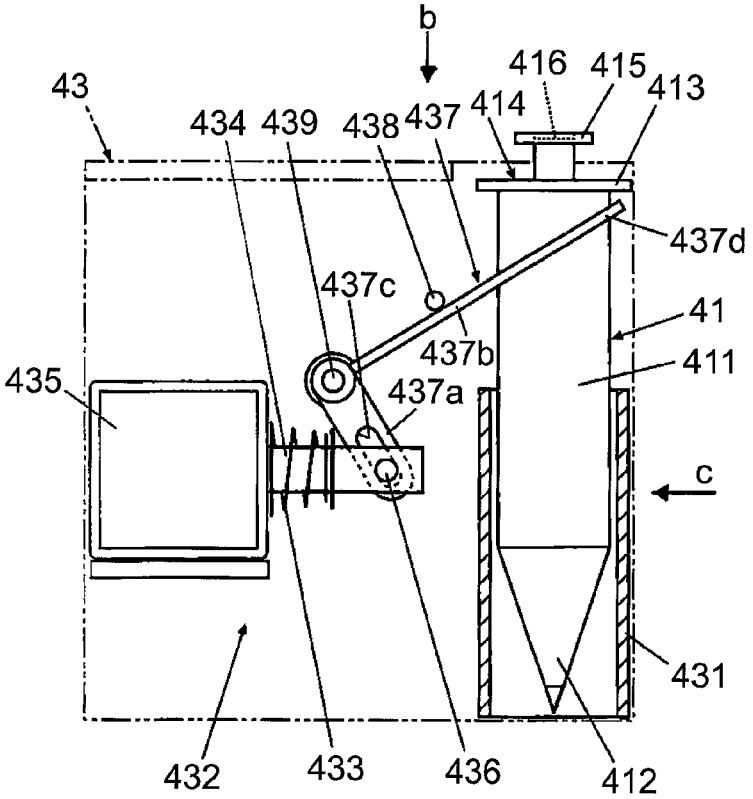
FIG. 7A is an enlarged lateral view of a pen carriage and a pen held thereby in a non-drawing state.
Figure 7C:
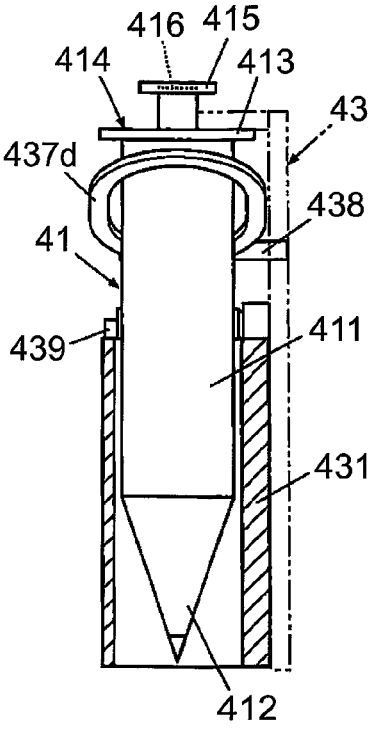
FIG. 7C is a front view of the pen carriage and the pen of FIG. 7A seen from the arrow c direction.

FIGS. 7A to 7C are enlarged views of the pen carriage 43 and the pen 41 held thereby in a non-drawing state.

Figure 8B:
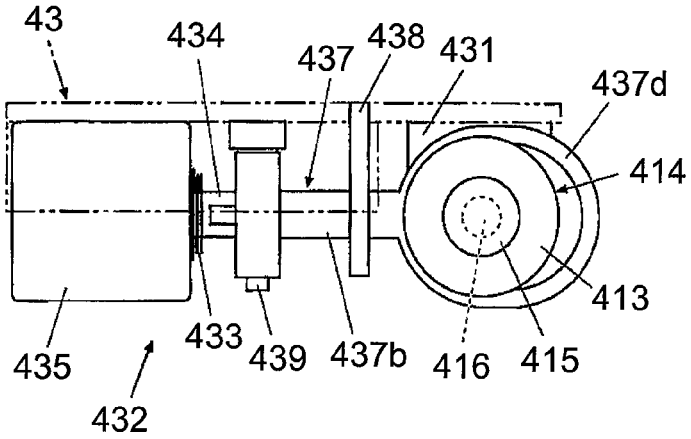
FIG. 8B is a top view of the pen carriage and the pen of FIG. 8A seen from the arrow b direction.
Figure 8A:
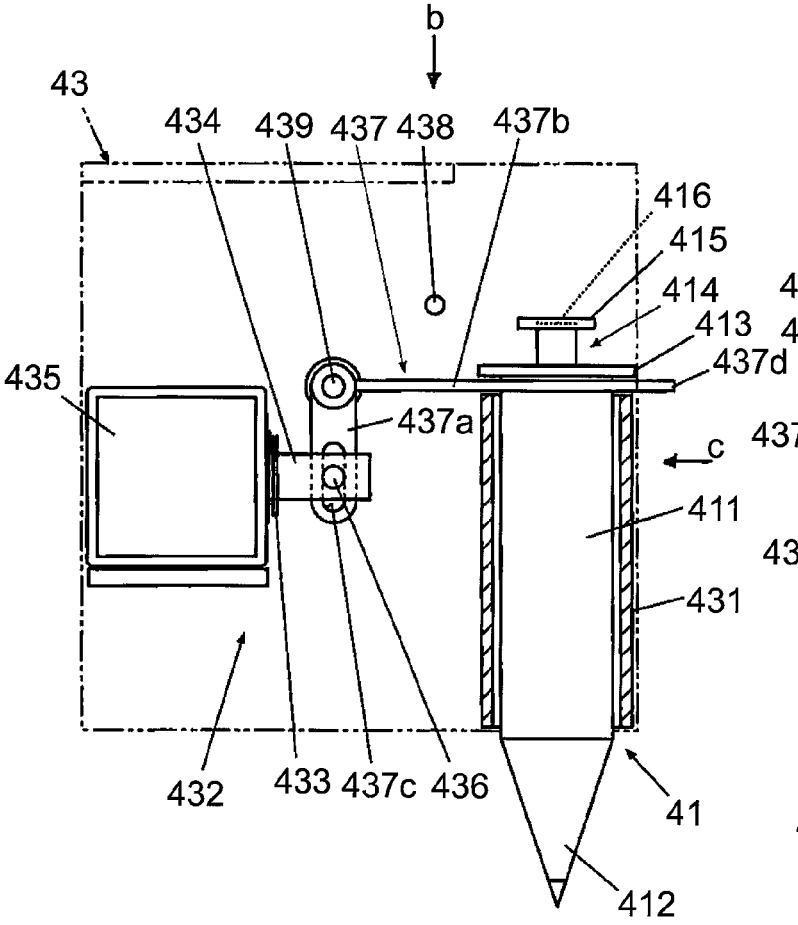
FIG. 8A is an enlarged lateral view of a pen carriage and a pen held thereby in a drawing state.
Figure 8C:
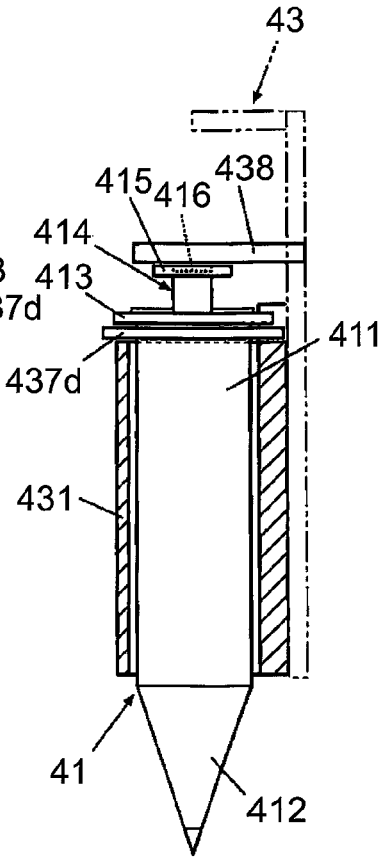
FIG. 8C is a front view of the pen carriage and the pen of FIG. 8A seen from the arrow c direction.

FIGS. 8A to 8C are enlarged views of the pen carriage 43 and the pen 41 held thereby in a drawing state.

FIGS. 7A and 8A are lateral views of the pen carriage 43 and the pen 41.

FIGS. 7B and 8B are top views of the pen carriage 43 and the pen 41 of FIGS. 7A and 8A, respectively, seen from the arrow b direction.

FIGS. 7C and 8C are front views of the pen carriage 43 and the pen 41 of FIGS. 7A and 8A, respectively, seen from the arrow c direction.

As shown in FIGS. 7A to 7C and 8A to 8C, each of the pens 41 held by the pen carriages 43 is provided with the pen tip (tip portion) 412 at the one end of a pen shaft 411.

The inside of the pen shaft 411 is an ink containing unit which contains various ink (liquid material).

The ink to be contained inside the pen shaft 411 is not especially limited in viscosity and particle diameter (size of particle) of color material and such like. Ink including gold and silver lame, white ink, ultraviolet curable ink, and ink for gel nail, undercoat, topcoat and manicure can also be used, for example.

At the other end of the pen shaft 411, a cover unit 414 including a flange portion 413 which extends outside the pen shaft 411 is attached.

Materials forming the pen shaft 411 and the cover unit 414 are not especially limited. However, the preferable material forming the pen shaft 411 and the cover unit 414 is resin and such like to reduce the weight of the pen 41.

In the embodiment, a finger grip unit 415 is provided at the upper portion of the cover unit 414 so as to be easily pinched by a hand, a pair of tweezers and such like. A small iron piece 416 is further provided to the finger grip unit 415 by embedding, attachment and such like so as to be absorbed to a magnet.

The pen 41 draws a picture by the pen tip 412 being pressed against the surface of the nail T and the ink contained in the pen shaft 411 being ejected, and the pen tip 412 of the pen 41 is a ballpoint pen type.

The pen 41 is not limited to the ballpoint pen type. The pen 41 may be a felt pen type which draws with ink sinking through the pen tip made of felt or a calligraphy pen type which draws with ink sinking through a tied brush, for example. The thickness and shape of the pen tip 412 are also not limited to the illustrated shape and various types of pen tips can be used.

The pens 41 to be held by the pen carriages 43 may have the pen tips 412 of a same type or may have different types of pen tips 412.

Each of the pens 41 is merely inserted into a pen holding unit 437*d* and a pen holder 431 of a pen carriage 43 from above to be held as described later. Thus, the pen 41 can be replaced easily by a method such as pinching the finger grip unit 415 with a hand or a pair of tweezers or by approaching a stick member (not shown in the drawings) which has a magnet attached at the tip toward the hand grip unit 415 to absorb and raise the iron piece 416 to the magnet after opening the pen replacement cover 23 provided at the case main body 2, for example.

Thus, the user can appropriately and easily replace the pens 41 to be set in the pen carriages 43 with the pens having different types of pen tips 412 or ink according to the nail design to be drawn. Thus, the user can achieve a wide range of nail designs.

In the embodiment, four pen carriages 43 holding the pens 41 are aligned in the width direction (lateral direction, X-direction in FIG. 3, for example) of the apparatus. Thus, the positions of the pen tips 412 of the pens 41 are shifted from each other in the X-direction (lateral direction of the apparatus). The shift is an integral multiple of one step in the drawing operation, and the drawing is performed by correcting the operation for the number of steps corresponding to the amount of the shift according to each of the pens 41 used for the drawing, and thus the four pens 41 can perform drawing at the same position.

Each of the pen carriages 43 is provided with the pen holder 431 which nearly vertically holds the pen 41 and a pen lifting mechanism 432 for moving the pen 41 up and down.

The pen holder 431 is a tube to insert the pen tip 412 and the pen shaft 411 and holds the pen 41.

The pen lifting mechanism 432 includes a cylindrical plunger 434 which is forced forward (to the right direction in FIGS. 4, 7A and 8A) by a spring 433 and performs reciprocating motion like a piston, a solenoid 435 which is a push type that holds the plunger 434 backward (to the left direction in FIGS. 4, 7A and 8A) against the elastic force of the spring 433 and pushes a magnetic body out of a coil (push type) or sucks the magnetic body into the coil (pull type), a lever supporting shaft 436 which is attached to the moving end of the plunger 434, a pen lifting lever 437 which is joined to the plunger 434 via the lever supporting shaft 436 and a stopper 438 which suppresses too much elevation of the pen lifting lever 437.

As shown in FIGS. 7A and 8A, the pen lifting lever 437 is an L-shaped member in which a shorter arm 437*a* is nearly perpendicular to a longer arm 437*b*.

A long hole 437*c* to be locked to the lever supporting shaft 436 is formed at the end portion of the shorter arm 437*a*.

The pen holding unit 437*d* to insert the pen 41 is provided at the end portion of the longer arm 437*b*.

The pen holding unit 437*d* is formed in a ring shape having an inner diameter which is larger than the diameters of the pen shaft 411 and the pen tip 412 of the pen 41 and smaller than the flange portion 413 of the pen 41. The pen shaft 411 and the pen tip 412 are inserted through the pen holding unit 437*d*, which locks the flange portion 413 so as to support it from below.

A rotation shaft 439 is inserted through the intersection of the shorter arm 437*a* and the longer arm 437*b* in the pen lifting lever 437 from the pen carriage 43 side.

In the embodiment, when the solenoid 435 is being driven, as shown in FIG. 8A, the plunger 434 is pulled back against the elastic force of the spring 433. At that time, the pen lifting lever 437 locked to the lever supporting shaft 436 of the plunger 434 is held at a position where the longer arm 437*b* is nearly horizontal. In this state, the pen tip of the pen 41 is lowered to be lower than the pen holder 431 of the pen carriage 43 so as to be contactable to the surface of the nail T and the drawing medium 61*a*, which is a drawing state.

When the solenoid 435 is released, as shown in FIG. 7A, the plunger 434 protrudes forward by the elastic force of the spring 433. At this time, the pen lifting lever 437 locked to the lever supporting shaft 436 of the plunger 434 is rotated upward (counterclockwise direction) around the rotation shaft 439 as a supporting point, and the longer arm 437*b* contacts with the stopper 438 to be stopped. Thus, the flange portion 413 of the pen 41 is flipped up by the pen lifting lever 437.

In this state, the pen tip of the pen 41 is lifted upper than the pen holder 431 of the pen carriage 43 and does not contact with the surface of the nail T and the drawing medium 61*a*, which is a non-drawing state.

In such way, the force moving the plunger 434 forward and backward by the solenoid 435 is converted into a force moving the pen 41 upward and downward by the rotation shaft 439 and the pen lifting lever 437 which is rotated around the rotation shaft 439 as the supporting point.

The pen 41 is merely inserted into the pen holder 431 of the pen carriage 43 to be held and not fixed to the pen lifting lever 437 and such like, and the pen 41 is forced downward by its own weight.

Thus, the pen 41 can move down freely along the pen holder 431 to the position where the flange portion 413 contacts the upper surface of the pen holding unit 437*d*. When contacting the nail T surface or the drawing medium 61*a*, the pen tip 412 is pressed against the nail T surface and the drawing medium 61*a*.

That is, in a case where drawing is performed with the pen 41 on the nail T, the pen tip 412 is configured to be able to freely move in the Z direction (that is, upward and downward) orthogonal to the X-Y plane on which the printing finger U1 is placed in accordance with the surface shape (unevenness of the surface and such like) of the nail T (in accordance with the curved surface or height of the nail T).

Figure 9A:
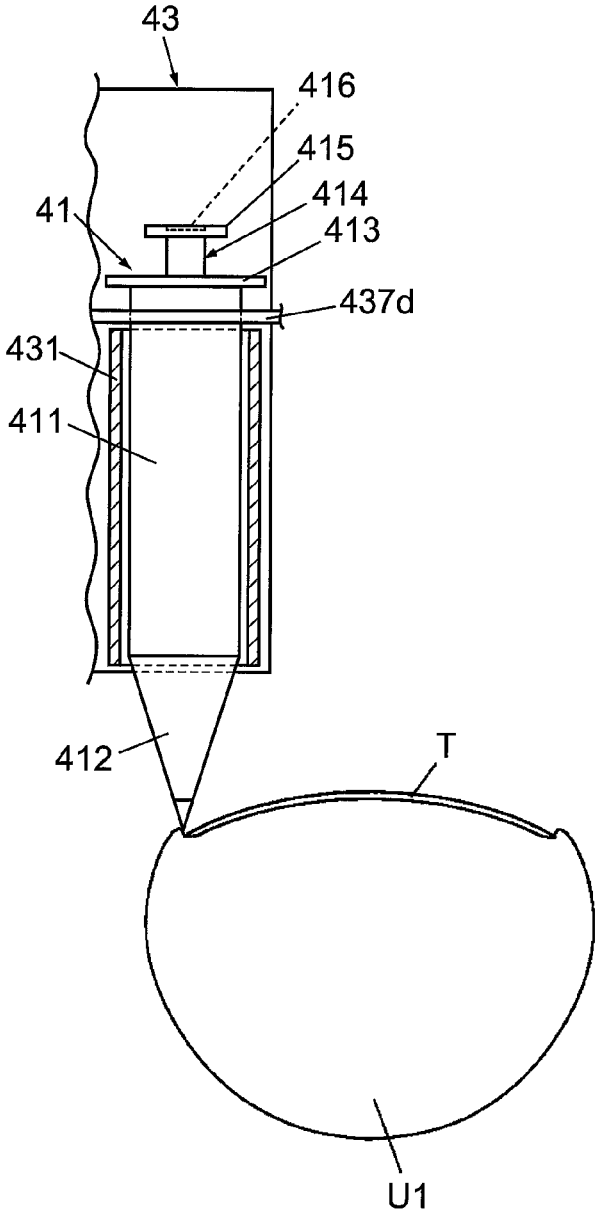
FIG. 9A is a sectional view of the pen which is drawing on a lower portion of a nail.
Figure 9B:
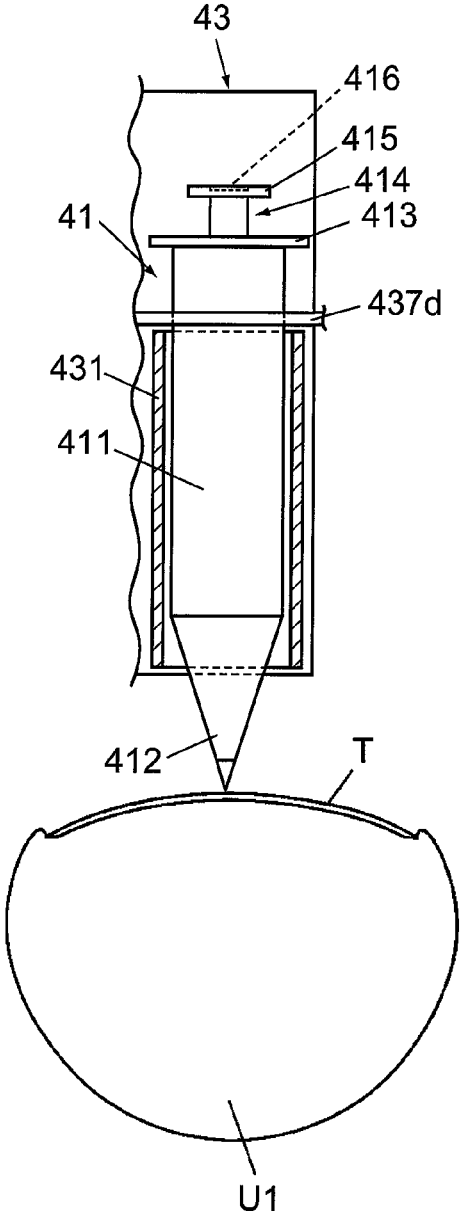
FIG. 9B is a sectional view of the pen which is drawing on a higher portion of the nail.

For example, when drawing is performed on a lower portion (such as both end portions in the width direction of the nail T) of the nail T, the pen 41 is lowered near the position where the flange portion 413 contacts the upper surface of the pen holding unit 437*d* as shown in FIG. 9A. When drawing is performed on a higher portion of the nail T (such as a central portion in the width direction of the nail T), the pen 41 is lifted in accordance with the height of the nail T and the flange portion 413 is moved away from the upper surface of the pen holding unit 437*d* as shown in FIG. 9B.

Since the pen 41 is extremely light that the weight thereof is several tens of grams, the user does not feel pain when the pen tip 412 contacts the nail T. Since the writing pressure of the pen 41 is secured by its own weight, the user can draw a nail design on the nail T and such like.

In the embodiment, among the members forming the pen lifting mechanism 432, the rotation shaft 436 and the stopper 438 are formed of metal such as stainless steel, and the other members are formed of materials such as resin which are light and do not react to a magnet.

The materials of the members forming the pen lifting mechanism 432 are not limited to the examples illustrated here.

In the embodiment, the solenoid 435 is used as an actuator for moving the pen 41 up and down. However, the actuator for moving the pen 41 up and down is not limited to the solenoid 435. Since the pen 41 is light, the actuator for moving the pen 41 up and down can be formed by various types of compact driving devices as well as the solenoid.

The unit supporting member 44 which supports the drawing head 42 is fixed to the X-direction movement unit 451 which is attached to the X-direction movement stage 45.

The X-direction movement unit 451 is moved in the X-direction along the guide which is not shown in the drawings on the X-direction movement stage 45 by the drive of the X-direction movement motor 46. Thus, the drawing head 42 is moved in the X-direction (X-direction in FIGS. 3 and 6, lateral direction of the nail print apparatus 1).

The X-direction movement stage 45 is fixed to the Y-direction movement unit 471 of the Y-direction movement stage 47.

The Y-direction movement unit 471 is moved in the Y-direction along the guide which is not shown in the drawings on the Y-direction movement stage 47 by the drive of the Y-direction movement motor 48. Thus, the drawing head 42 is moved in the Y-direction (Y-direction in FIGS. 4 and 6, front-back direction of the nail print apparatus 1).

In the embodiment, the X-direction movement stage 45 and the Y-direction movement stage 47 are formed by combining the X-direction movement motor 46 and the Y-direction movement motor 48 which are stepping motors, and ball screws and guides which are not shown in the drawings.

In the embodiment, a head driving unit 49 which drives the drawings head 42 including the pens 41 that draw on the nail T in X-direction and Y-direction is formed by the X-direction movement motor 46 and the Y-direction movement motor 48.

The X-direction movement motor 46 and the Y-direction movement motor 48 are stepping motors, for example.

The X-direction movement motor 46 and the Y-direction movement motor 48 are not especially limited as long as they can arbitrarily move the drawing head 42 back and forth and left and right. A servomotor may be applied as well as the stepping motor, for example.

The solenoids 435, the X-direction movement motor 46 and the Y-direction movement motor 48 in the drawing unit 40 for moving the pen 41 up and down are connected to a drawing control unit 815 (see FIG. 10) of an after-mentioned control device 80 and controlled by the drawing control unit 815.

As shown in FIGS. 2 to 4, a photographing unit 50 is provided on the upper machine casing 12.

A substrate 13 is set on the upper machine casing 12, and a camera 51 is set at the central portion of the lower surface of the substrate 13. It is preferable that the camera 51 has approximately two million pixels or more, for example.

The camera 51 is a photographing device which photographs the nail T (printing finger U1 including the nail T) of the printing finger U1 inserted into the finger inserting unit 31.

On the substrate 13, lights (lighting device) 52 such as white LEDs are set so as to surround the camera 51.

The lights 52 illuminate the nail T of the printing finger U1 at photographing by the camera 51. The photographing unit 50 is configured by including the camera 51 and the lights 52.

In the embodiment, an after-mentioned nail information detecting unit 812 (see FIG. 10) detects nail information such as the shape of the nail T and the position of the nail T (including position in the height direction of the nail T) on the basis of the image of nail T (image including the nail image) obtained by the camera 51 as the photographing device.

The photographing unit 50 is connected to a photographing control unit 811 (see FIG. 10) in the after-mentioned control device 80 and controlled by the photographing control unit 811.

Image data of the image obtained by the photographing unit 50 is stored in a nail image storage area 821 of an after-mentioned storage unit 82.

The control device 80 is set on the substrate 13 disposed on the upper machine casing 12 and the like, for example.

Figure 10:
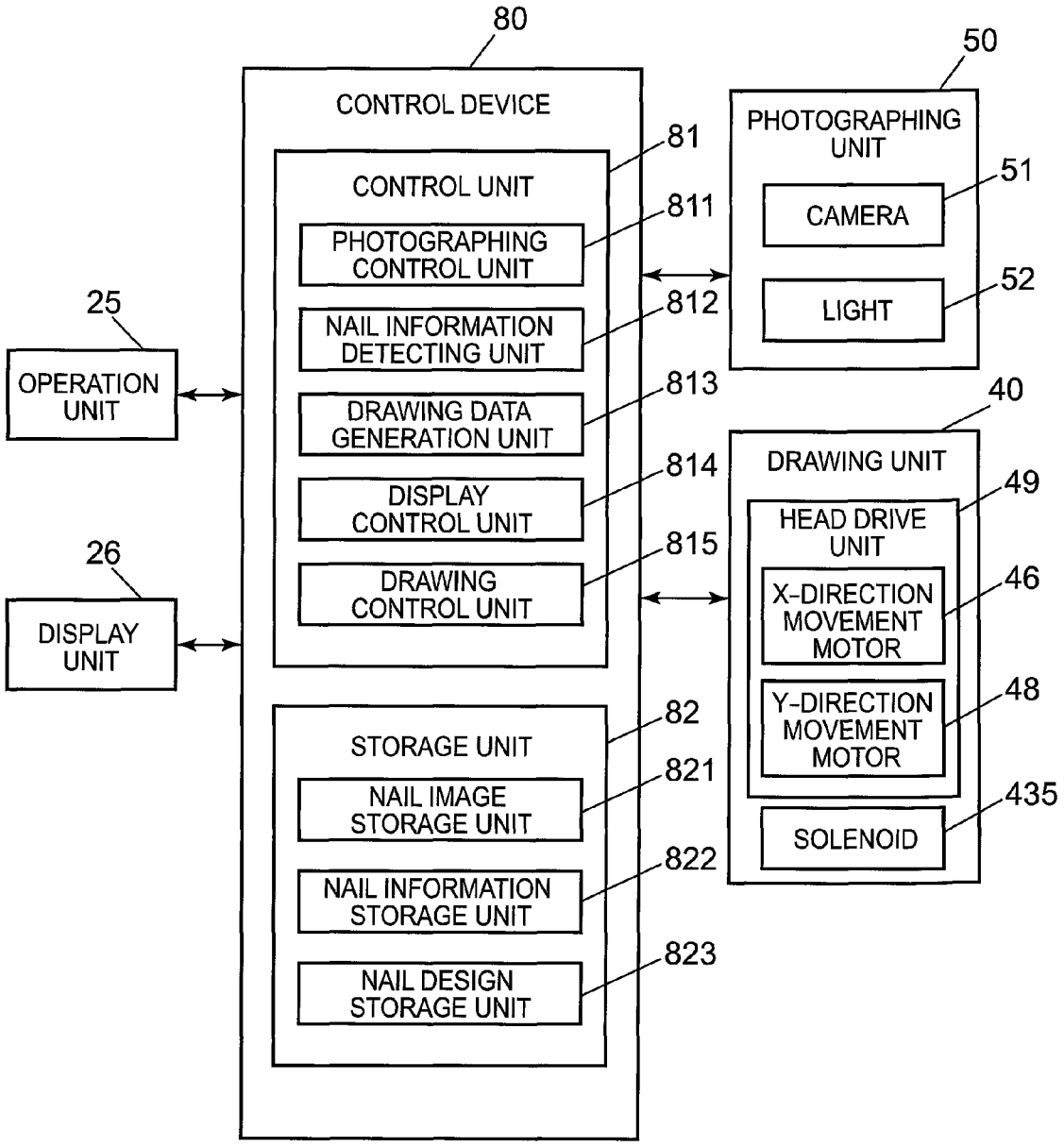
FIG. 10 is a main part block diagram showing a control structure of the nail print apparatus according to the embodiment.

FIG. 10 is a main part block diagram showing a control structure in the embodiment.

As shown in FIG. 10, the control device 80 is a computer which includes a control unit 81 having a CPU (Central Processing Unit) and the storage unit 82 having a ROM (Read only memory), a RAM (Random access memory) and such like which are not shown in the drawings.

Various programs for operating the nail print apparatus 1 and various data are stored in the storage unit 82.

Specifically, in the ROM of the storage unit 82, various programs such as a nail information detecting program for detecting nail information such as the shape and position of the nail T from the nail image and a drawing data generation program for generating drawing data and a drawing program for performing a drawing process are stored. The control device 80 executes the programs to integrally control the units of the nail print apparatus 1.

In the embodiment, the storage unit 82 is provided with a nail image storage area 821 for storing a nail image of the nail T of the printing finger U1 of the user obtained by the photographing unit 50, a nail information storage area 822 for storing the nail information detected by the nail information detecting unit 812 and a nail design storage area 823 for storing image data of nail designs to be drawn on the nail T.

In a functional view, the control unit 81 includes the photographing control unit 811, the nail information detecting unit 812, the drawing data generation unit 813, the display control unit 814, the drawing control unit 815 and such like.

The functions as the photographing control unit 811, the nail information detecting unit 812, the drawing data generation unit 813, the display control unit 814, the drawing control unit 815 and such like are achieved in cooperation between the CPU of the control unit 81 and the programs stored in the ROM of the storage unit 82.

The photographing control unit 811 controls the camera 51 and the lights 52 of the photographing unit 50 to photograph the image of the nail T of the printing finger U1 inserted into the finger receiving unit 31 with the camera 51.

In the embodiment, the photographing control unit 811 controls the camera 51 and the lights 52 of the photographing unit 50 to photograph the nail T of the printing finger U1 exposed from a window 31*e* in FIG. 6 and obtains the image of nail T.

The nail information detecting unit 812 detects the nail information for the nail T of the printing finger U1 on the basis of the image (finger image including a nail image) of the nail T of the printing finger U1 inserted into the finger inserting unit 31 which is obtained by the camera 51.

Here, the nail information includes the outline of the nail T (the nail shape and horizontal position of the nail T), the height of the nail T (location in the vertical direction of the nail T, hereinafter, called "vertical position of the nail T" or merely called "position of the nail T") and the curvature of the nail T (nail curvature), and the nail information detecting unit 812 detects at least one of the shape of the nail T, the position of the nail T and the curvature of the nail T as the nail information.

In the embodiment, the nail information detecting unit 812 detects all of the shape of the nail T, the position of the nail T and the curvature of the nail T on the basis of the finger image including the nail image.

Specifically, the nail information detecting unit 812 detects the outline (shape and size) and position of the nail T from the finger image including the nail image of the nail T of the printing finger U1 which is obtained by the camera 51 and obtains the outline as information represented by x and y coordinates and such like.

The nail information detecting unit 812 detects the outline (shape) of the nail T on the basis of the difference in color and such like between the nail T and the other finger portion from the finger image including the nail image of the nail T of the printing finger U1 obtained by the camera 51, for example.

The method of detecting the outline (shape) of the nail T by the nail information detecting unit 812 is not especially limited, and not limited to the above examples.

Also, the nail information detecting unit 812 detects the nail height for the nail T on the basis of the image of nail T obtained by the camera 51. Here, the nail height is the vertical position of the nail T.

Further, the nail information detecting unit 812 detects the nail curvature for the nail T on the basis of the image of nail T obtained by the camera 51. The nail curvature is a curvature in the width direction of the nail T.

For example, by photographing the nail T from two different angles with the camera 51, the nail information detecting unit 812 can estimate the nail height and the nail curvature for the nail T from the change in shade or such like appearing on the nail image.

The method of detecting the nail height and nail curvature by the nail information detecting unit 812 is not especially limited, and not limited to the above example.

The drawing data generation unit 813 generates data for the drawing to be performed on the nail T of the printing finger U1 by the drawing head 46 on the basis of the nail information detected by the nail information detecting unit 812.

Specifically, the drawing data generation unit 813 performs a fitting process by enlarging, reducing, cutting out and such like the image data of the nail design on the basis of the shape and such like of the nail T detected by the nail information detecting unit 812, and generates data for performing drawing on the nail T.

The display control unit 814 controls the display unit 26 to display various display screens on the display unit 26.

In the embodiment, for example, the display control unit 814 makes the display unit 26 display a selection screen of nail design, thumbnail images for design confirmation, a finger image obtained by photographing the printing finger U1, a nail image included in the finger image, and various instruction screens.

The drawing control unit 815 outputs the drawing data generated by the drawing data generation unit 813 to the drawing unit 40 and controls the solenoid 435, the X-direction movement motor 46 and the Y-direction movement motor 48 of the drawing unit 40 so as to perform drawing on the nail T according to the drawing data.

Next, operations and a using method of the nail print apparatus 1 in the embodiment will be described.

When drawing is to be performed by the nail print apparatus 1, the user turns the power switch on to activate the control device 80.

The display control unit 814 makes the display unit 26 display the design selection screen.

The user operates the operation buttons 251 and such like of the operation unit 25 to select a desired nail design among a plurality of nail designs displayed on the design selection screen. Thus, a selection instruction signal is output from the operation unit 25 to select the nail design to be drawn on the nail T.

When the nail design is selected, the control unit 81 makes the display unit 26 display an instruction screen which instructs setting pens 41 needed to draw the selected nail design in predetermined pen carriages 43 of the drawing head 42.

For example, when red ink and gold ink which includes lame are necessary, pen carriages 43 to set in the pens 41 of respective ink are instructed on the display unit 26.

According to the instruction displayed on the display screen, the user sets the predetermined types of pens 41 in the predetermined pen carriages 43.

The user may intentionally set a pen 41 different from the instructed pen to achieve a nail design of his/her favorite color and texture.

The configuration may be such that the control unit 81 can read out what type of pen 41 is set in the pen carriage 43 by a barcode or such like. In such case, nail designs which can be drawn by the pen 41 set in the pen carriage 43 may be displayed on the design selection screen of the display unit 26 to enable the user to select a nail design among them.

Next, the user inserts the printing finger U1 into the finger receiving unit 31 and inserts the non-printing fingers U2 into the finger resting unit 32 to fix the printing finger U1, and then operates a drawing switch. For example, FIGS. 5 and 6 show an example in which the ring finger of the left hand is inserted into the finger receiving unit 31 as the printing finger U1 and the other fingers are inserted into the finger resting unit 32 as the non-printing fingers U2.

When the instruction is input from the drawing switch, before starting the drawing operation, the photographing control unit 811 controls the photographing unit 50 first to photograph the printing finger U1 with the camera 51 while illuminating the printing finger U1 with the lights 52.

Thus, the photographing control unit 811 obtains an image of the nail T of the printing finger U1 inserted into the finger receiving unit 31.

Next, the nail information detecting unit 812 detects (calculates) the outline (nail shape and size) of the nail T, the nail position (including horizontal and vertical positions of nail) and the nail curvature on the basis of the image of nail T.

When the shape of nail T, position of nail T and curvature of nail T are detected by the nail information detecting unit 812, the drawing data generation unit 813 performs fitting of the image data of nail design into the nail T on the basis of the nail information. Also, the drawing data generation unit 813 performs curved surface correction for the image data of nail design on the basis of the nail information. Thus, the drawing data is generated.

Before starting drawing on the nail T, the drawing control unit 815 moves the drawing unit 40 toward the pen test writing unit 61 and drives the solenoid 435 of the pen carriage 43 holding the pen 41 to enable the pen 41 to draw.

Then, test writing is performed by drawing a predetermined figure such as "o" and "∞" on the drawing medium.

The test writing may be performed only for the pen 41 necessary to draw the selected nail design or may be performed for all the pens 41.

When the drawing data is generated and test writing is also completed, the drawing control unit 815 outputs the drawing data to the drawing unit 40 and drives the solenoid 435 of the pen carriage 43 holding the pen 41 necessary for the drawing to enable the pen 41 to perform drawing, and appropriately moves the drawing head 42 in the X direction and Y direction on the basis of the drawing data to perform drawing on the nail T.

At that time, the pen 41 is pressed against the surface of the nail T by its own weight and performs drawing while moving up and down in accordance with the surface shape of the nail T.

When drawing is performed on nails T of a plurality of fingers, after the drawing process for the nail T of a finger is finished, the finger in which the drawing has been performed on the nail T is removed from the finger receiving unit 31, a finger of a nail T to perform drawing next is inserted as the printing finger U1 into the finger receiving unit 31 to obtain the nail image of the nail T, and the above process is repeated.

When replacing the pen 41, the drawing control unit 815 moves the drawing head 42 to a position corresponding to the pen replacement cover 23. By the user opening the pen replacement cover 23 in this state, the pen 41 can be removed to be replaced.

FIGS. 11A to 11I show examples of nail designs which can be drawn on the nail T by the nail print apparatus 1 in the embodiment.

Figure 11A:
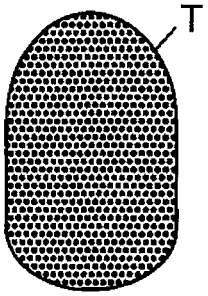
FIGS. 11A to 11I are nail plan views which show drawing examples by the nail print apparatus in the first embodiment.

Pens 41 with various types of pen tips 412 can be applied to the nail print apparatus 1 in the embodiment as described above. Thus, the entire nail T can be coated evenly as shown in FIG. 11A by using a pen 41 such as a ballpoint pen type, a felt pen type and a calligraphy pen type having a thick pen tip 412, for example. Alternatively, a transparent base coat, top coat or such like can also be applied to the entire nail T.

Figure 11B:
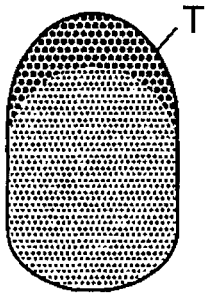

Since ink which has a large particle diameter and produces good color can be used, color can be applied only to the nail tip of a natural nail T which has no coating or a nail T which is coated with a transparent manicure to make a French nail as shown in FIG. 11B.

Figure 11C:
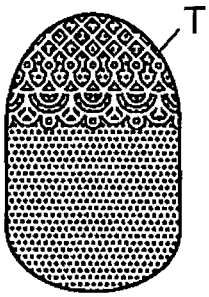

By using a pen 41 with a thin pen tip 412, a delicate picture such as a lace pattern shown in FIG. 11C can also be drawn.

Figure 11D:
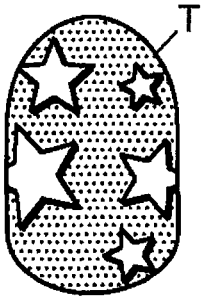
Figure 11E:
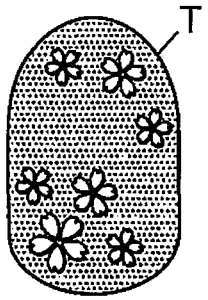

As shown in FIGS. 11D and 11E, a motif such as a star or a flower can be drawn by using ink of gold, silver and suchlike while utilizing the ground color of a natural nail T which has no coating or a nail T which is coated with a transparent manicure.

Figure 11F:
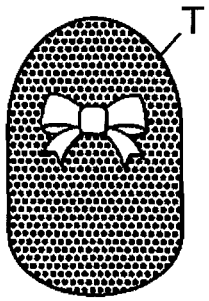
Figure 11G:
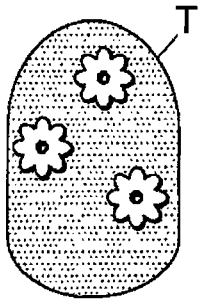

Furthermore, since white ink and such like can also be used, as shown in FIGS. 11F and 11G, after coating a color to the entire nail T, a motif such as a ribbon or a flower can be drawn by white ink.

Figure 11H:
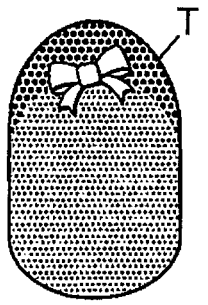
Figure 11I:
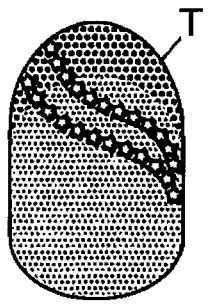

Also, since a plurality of pen carriages 43 are provided to the drawing head 42 and a plurality of types of (four types at most in the embodiment) pens 41 can be set, as shown in FIGS. 11H and 11I, it is possible to achieve nail designs which are a design using three or more colors and a design having a delicate picture such as a splendid rhinestone pattern made by coating ink on the entire nail T with a pen 41 of a thick pen tip 412 and thereafter applying "gold lame" or "silver lame" with a pen 41 of a thin pen tip 412, for example.

Under coating and top coating may also be performed by the nail print apparatus 1 by setting pens 41 including ink for under coat and ink for top coat in the pen carriages 43.

The user may finish the nail art by applying a top coat after drying the drawing which is performed by the nail print apparatus 1.

As described above, according to the nail print apparatus 1 of the embodiment, drawing can be performed on a nail T by moving a drawing head 42 which includes pens 41 for drawing on the nail T in the X direction and Y direction.

Thus, compared to conventional ink-jet type print heads, it is possible to widely use ink including various types of color materials such as viscous ink, ink including gold or silver lame and white ink.

Thus, it is possible to produce an ink color clearly even without coating a base of white color and such like, and save the trouble of coating the base. In addition, it is also possible to draw a design which utilizes a ground color or such like of the nail T. Thus, the user has more choices of nail designs which can be drawn.

Furthermore, in a case of coating an under coat or top coat and in a case of coating a color on the entire nail T, the coating can be performed rapidly and evenly by using a pen 41 with a thick pen tip 412 or a pen 41 which is a calligraphy pen type. Thus, the user can save the trouble of coating a base or such like by himself/herself, degradation of image quality due to uncoated area, uneven coating and such like is not generated and the nail art can have a beautiful finish.

Since ink which can be used is not limited, it is possible to easily apply a nail print to the nail T by the nail print apparatus 1, the nail print being varied and having a beautiful finish, similar to nail prints performed in nail salons, such as a splendid design using ink with lame and a design having thick, shiny and high-class look in finish.

Furthermore, since viscous ink such as ultraviolet curable gel nail can also be used, for example, it is possible to achieve a nail art which lasts long and has a beautiful finish similarly to nail arts performed in nail salons.

Since the nail information detecting unit 812 detects at least one (both in the embodiment) of the nail shape and the nail position as the nail information on the basis of the nail image, it is possible to perform drawing in accordance with the nail T of the user and thus achieve a clear nail art without an uncoated area or running off of coating.

The pen 41 is configured so as to be movable in the z direction (up and down) orthogonal to the x-y plane in accordance with the surface shape of the nail T. Thus, the pen tip 412 is appropriately pressed against both a higher portion and a lower portion of the nail T, and thus the pen 41 can perform drawing.

Since the pen 41 is pressed against the surface of the nail T by its own weight and can secure a predetermined writing pressure, the configuration can be simplified.

Also, the drawing medium 61*a* for test writing other than nail T is provided within a movable range of the drawing head 42, and before performing drawing by the image data of the nail design on the nail T, a predetermined image such as "o" is drawn on the drawing medium 61*a*. Thus, blur of ink at the start of drawing on the nail T does not occur and drawing can be performed in an excellent state.

Since the medium inserting port 24 through which the drawing medium 61*a* can be replaced is provided, when the drawing medium 61*a* for test writing becomes dirty and cannot sufficiently serve the test writing function, the drawing medium 61*a* can be replaced with a new drawing medium 61*a* to enable the test writing again.

[Second Embodiment]

Next, with reference to FIGS. 12 to 17, a second embodiment of the nail print apparatus 1 according to the present invention will be described.

The embodiment is different from the first embodiment only in the configuration of drawing head of the nail print apparatus 1. Thus, the differences from the first embodiment will be mainly described hereinafter.

Figure 12:
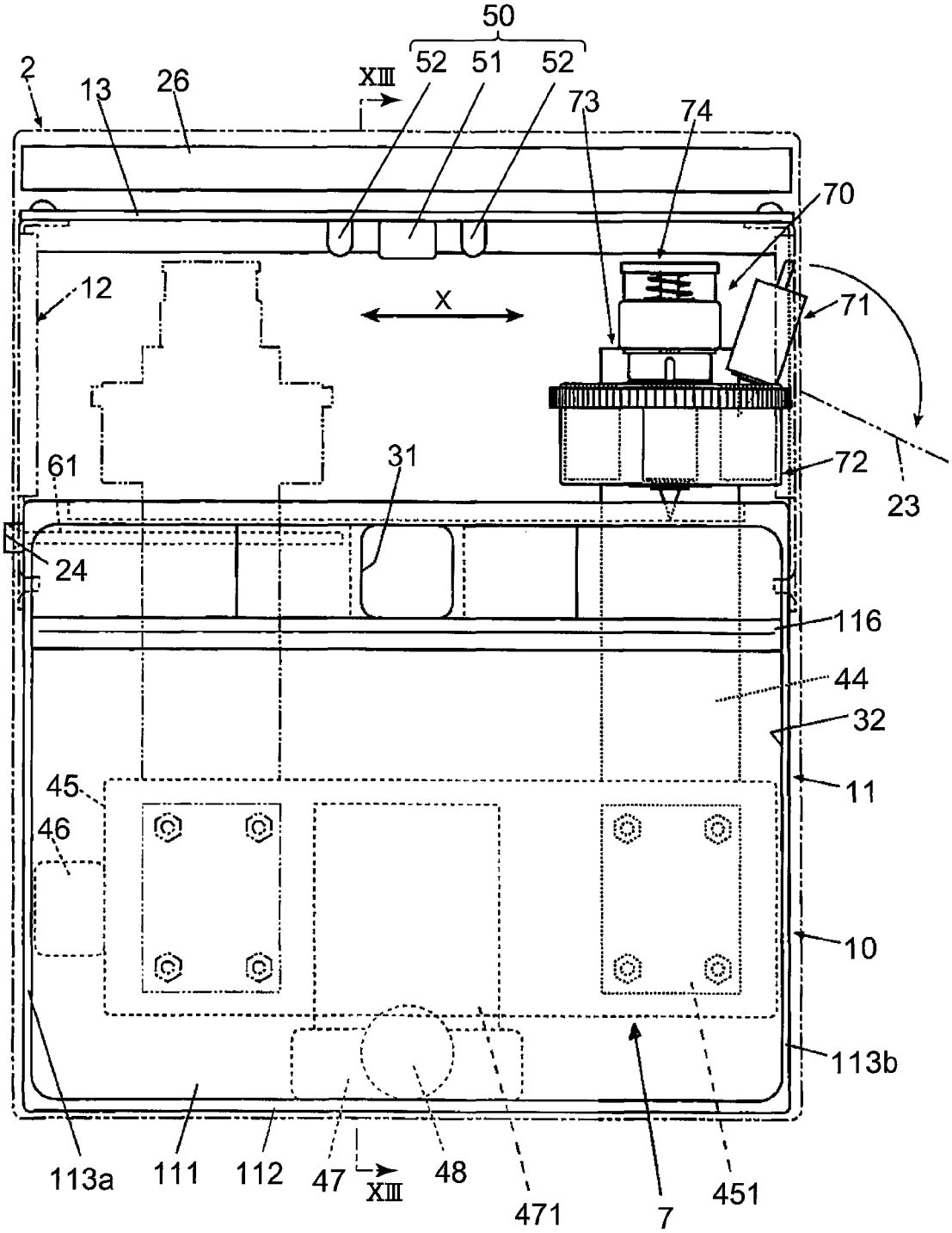
FIG. 12 is a front view of an apparatus main body of a nail print apparatus in a second embodiment.

FIG. 12 is a front view of the apparatus main body of the nail print apparatus 1 in the embodiment.

Figure 13:
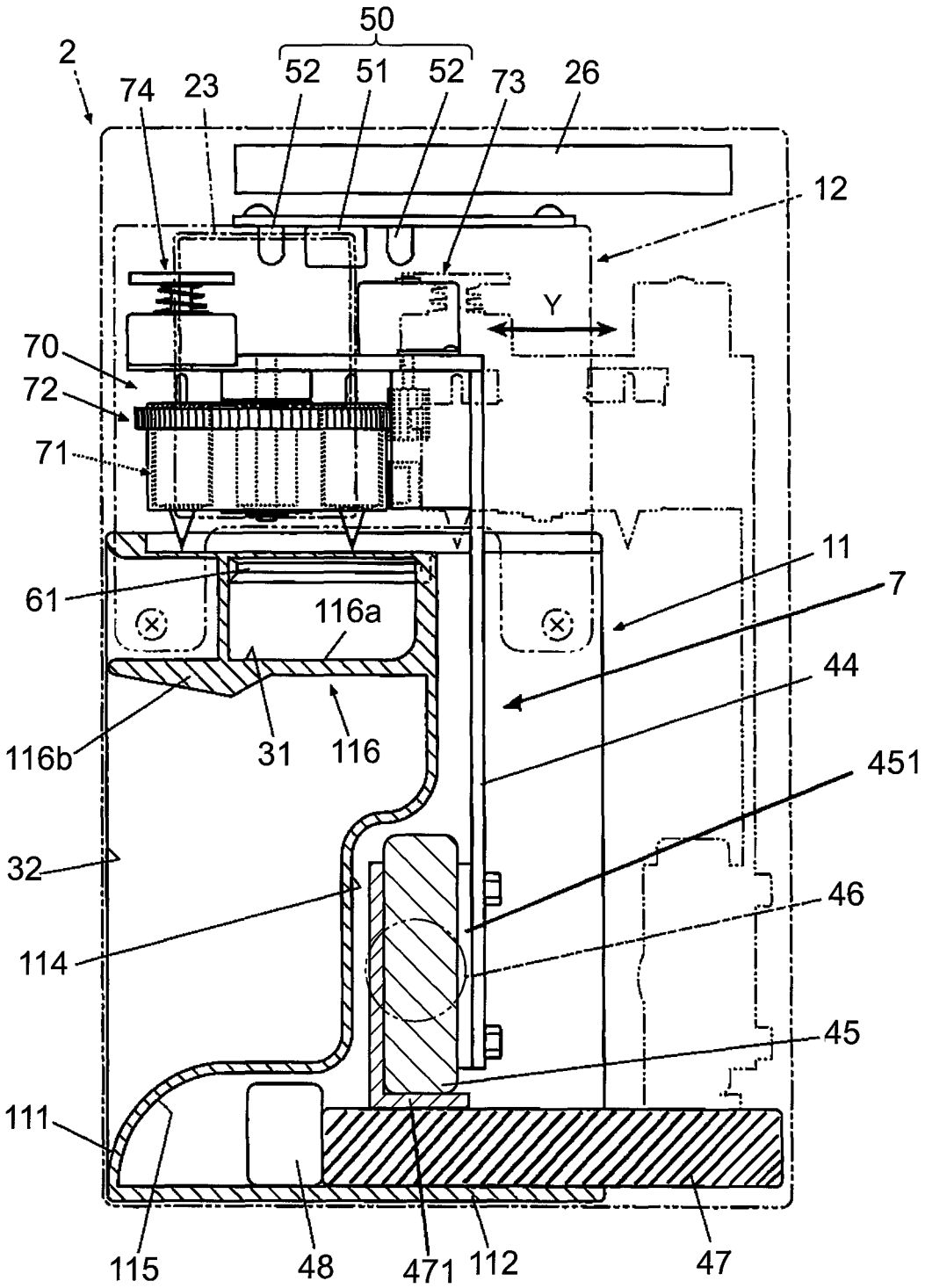
FIG. 13 is a sectional view of FIG. 12 cut along the line XIII-XIII.

FIG. 13 is a sectional view showing a cross section of FIG. 12 cut along the line XIII-XIII seen from the arrow direction.

As shown in FIGS. 12 and 13, the nail print apparatus 1 of the embodiment includes an apparatus main body 10 which has a nearly same configuration as the first embodiment and includes a case main body 2, a lower machine casing 11 and an upper machine casing 12.

At a position which is on a lateral surface of the case main body 2 and is corresponding to an after-mentioned drawing head 70, a pen replacement cover 23 is provided so as to be able to open and close to replace the pen 71.

The pen replacement cover 23 freely rotates from a closed state to an open state as shown in FIG. 12 via a hinge, for example.

Furthermore, at a lateral surface (in the embodiment, the left side surface in FIG. 12) of the case main body 2, as in the first embodiment, a medium inserting port 24 (see FIG. 12) thorough which a drawing medium 61*a* shown in FIG. 6 to be placed on a pen test writing unit 61 can be replaced is formed.

Also, as in the first embodiment, the pen test writing unit 61 for test writing of a pen 71 is provided within a movable range of an after-mentioned drawing head 70 next to (position corresponding to the medium inserting port 24 of the case main body 2) the finger receiving unit 31 on the upper surface of the dividing wall 116 of the lower machine casing 11.

Though not shown in the drawings, pen caps 62 as shown in FIG. 6 may be disposed near the pen test writing unit 61 as in the first embodiment.

A drawing unit 7 is provided inside the apparatus main body 10.

The drawing unit 7 is configured by including a drawing head 70, a unit supporting member 44 which supports the drawing head 70, an X-direction movement stage 45 for moving the drawing head 70 in the X direction (X direction in FIG. 12, lateral direction of the nail print apparatus 1), an X-direction movement motor 46, a Y-direction movement stage 47 for moving the drawing head 70 in the Y direction (Y direction in FIG. 13, front-back direction of the nail print apparatus 1), a Y-direction movement motor 48 and such like.

Figure 14A:
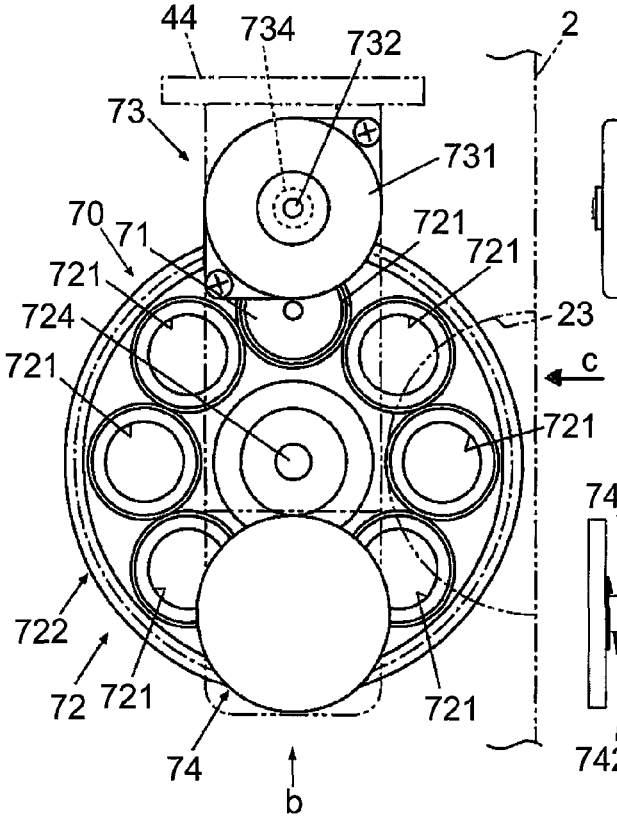
FIG. 14A is an enlarged top view of a drawing head in the second embodiment.

FIG. 14A is a top view of the drawing head 70.

Figure 14C:
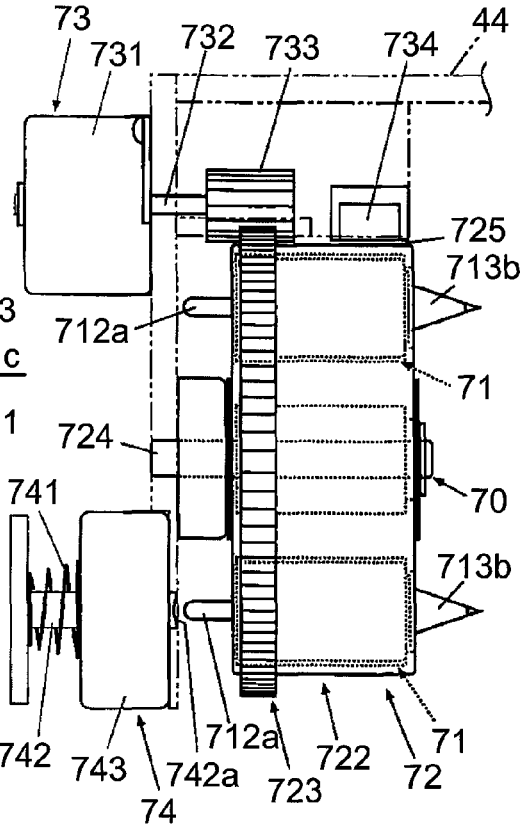
FIG. 14C is a front view of the drawing head of FIG. 14A seen from the arrow c direction.
Figure 14B:
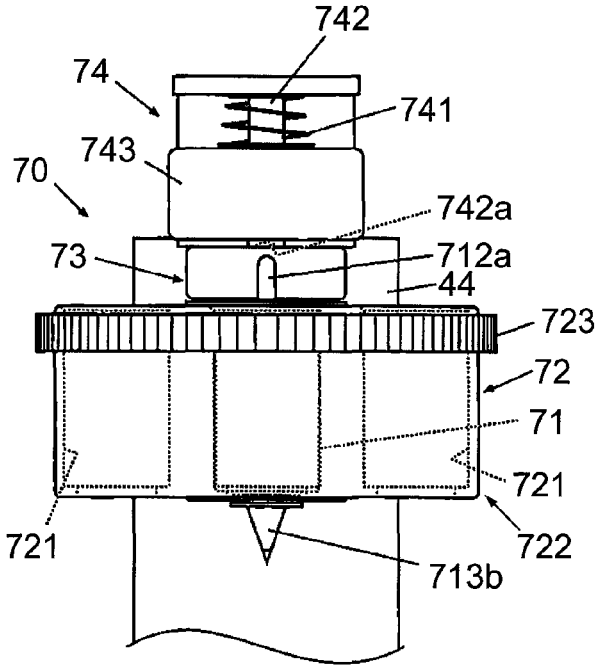
FIG. 14B is a top view of the drawing head of FIG. 14A seen from the arrow b direction.

FIG. 14B is a front view of the drawing head 70 of FIG. 14A seen from the arrow b direction.

FIG. 14C is a lateral view of the drawing head 70 of FIG. 14A seen from the arrow c direction.

As shown in FIGS. 14A to 14C, in the embodiment, the drawing head 70 includes a rotary pen carriage 72 which can hold a plurality of pens 71, a carriage rotation mechanism 73 which rotates the pen carriage 72 and a pen lifting mechanism 74 for moving the pens 71 held by the pen carriage 72 up and down.

The pen carriage 72 in the embodiment is formed to be disk-shaped and includes a carriage main body 722 in which eight pen holding units 721 are disposed along the circumference.

The number of the pen holding units 721 is not especially limited, and may be more than eight and less than eight.

By including more pen holding units 721, more various nail designs using a plurality of types of ink can be drawn.

All the pen holding units 721 do not need to hold the pens 71. FIGS. 14A and 14C show an example where pens 71 are held in two of eight pen holding units 721.

A gear 723 is formed on the outer circumferential surface of the carriage main body 722.

A rotation shaft 724 is provided at a nearly central portion of the pen carriage 72, and the pen carriage 72 is configured to be rotatable nearly horizontally around the rotation shaft 724.

A reference index 725 for indicating a reference position of rotation of the pen carriage 72 is provided at a predetermined position (for example, a position corresponding to a predetermined pen holding unit 721) on the outer circumferential surface of the carriage main body 722 of the pen carriage 72.

The reference index 725 is a reflective cloth or a reflective sheet readable by a photoreflector, for example, and is fixed to the outer circumferential surface of the carriage main body 722 by adhesion and such like.

As shown in FIG. 14C, the carriage rotation mechanism 73 includes a stepping motor 731 and a gear 733 which is connected to the stepping motor 731 via the rotation shaft 732 and is engaged with the gear 723 of the carriage main body 722.

In the embodiment, the rotation shaft 732 is rotated by the drive of the stepping motor 731, and when the gear 733 attached to the rotation shat 732 is rotated, the gear 723 of the carriage main body 722 engaged with the gear 733 is rotated and the pen carriage 72 is rotated in a predetermined direction. The stepping motor 731 may be configured so as to be rotatable in the forward and backward direction.

The carriage rotation mechanism 73 includes an index reading unit 734 for reading out the index reference 725 of the pen carriage 72.

The index reading unit 734 is configured by including the photoreflector which can read out the reference index 725 formed of the reflective cloth or reflective sheet, for example.

The index reading unit 734 outputs a reading result to the drawing control unit 815 every time of reading the reference index 725.

The pen lifting mechanism 74 includes a plunger 742 which is forced upward (upward in FIG. 14B) by a spring 741 and a solenoid 743 which presses the plunger 742 downward against the elastic force of the spring 741.

A concave portion 742*a* which receives the end portion of a shaft 712*a* of the pen 71 is formed at the lower end portion of the plunger 742.

As after-mentioned, the end portion of the shaft 712*a* is formed in a hemisphere or spindle shape. Thus, by receiving the end portion of the shaft 712*a* at the concave portion 742*a*, it is possible to press down the shaft 712*a* and the pen 71 thereof itself stably in the vertical direction.

Figure 15A:
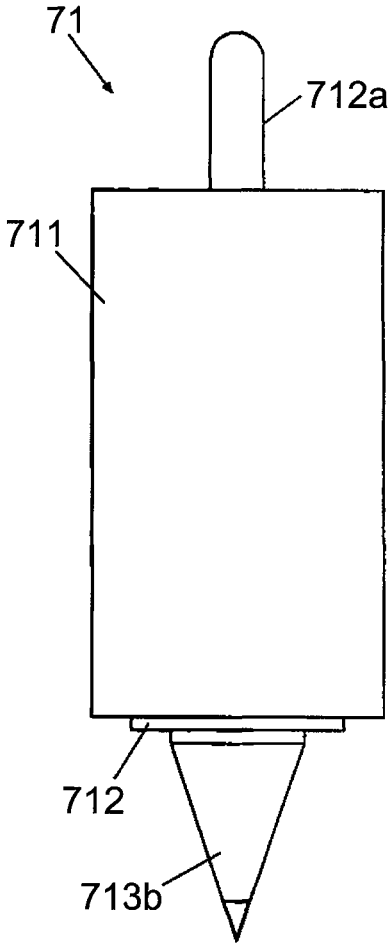
FIG. 15A is a plan view of a pen in the second embodiment.

FIG. 15A is a lateral view showing an outer appearance of the pen 71 held by the pen holding unit 721 as shown in FIGS. 14A to 14C in the embodiment.

Figure 15B:
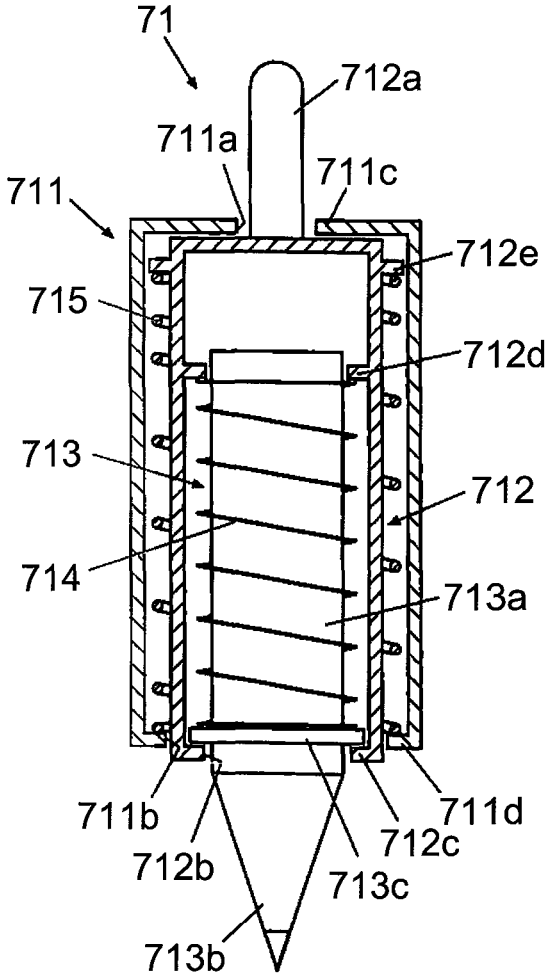
FIG. 15B is a sectional view of the pen of FIG. 15A.

FIG. 15B is a sectional view of the pen 71 shown in FIG. 15A.

As shown in FIGS. 15A and 15B, the pen 71 includes an external cylinder 711, an internal cylinder 712 contained in the external cylinder 711 and a pen main body 713 contained in the internal cylinder 712.

The external cylinder 711 is open at upper and lower ends, and an inward flange 711*c* is formed at an upper opening 711*a*. An inward flange 711*d* is formed at a lower opening 711*b*.

The internal cylinder 712 has a shaft 712*a* at the upper section, protruding from the upper opening 711*a* of the external cylinder 711.

The end portion of the shaft 712*a* is formed to be in a hemisphere or spindle shape.

The internal cylinder 712 has an opening 712*b* at the lower section.

The inward flange 712*c* is formed at the opening 712*b*.

An inward flange 712*d* extending inside the internal cylinder 712 is formed at the upper section inside the internal cylinder 712.

Furthermore, an outward flange 712*e* extending outside the internal cylinder 712 is formed at the upper section outside the internal cylinder 712.

The outer diameter of the internal cylinder 712 is smaller than the inner diameter of the lower opening 711*b* of the external cylinder 711, and the internal cylinder 712 can protrude from the lower opening 711*b* of the external cylinder 711.

In the pen main body 713, a pen tip (tip portion) 713*b* is provided at the one end (lower side in FIG. 15A, for example) of the pen shaft 713*a*.

The inside of the pen shaft 713*a* is an ink containing unit which contains various types of ink.

A flange portion 713*c* extending outwardly is provided between the pen shaft 713*a* and the pen tip 713*b*.

The outer diameter of the flange portion 713*c* is larger than the inner diameter of the opening 712*b* of the internal cylinder 712. Thus, the flange portion 713*c* contacts the inward flange 712*c* formed at the opening 712*b* of the internal cylinder 712, and the pen main body 713 contained in the internal cylinder 712 is held so as not to fall down from the lower portion.

A coil spring 714 is wound around the outer circumference of the pen main body 713.

An end of the coil spring 714 contacts the upper surface of the flange portion 713*c* and the other end contacts the lower surface of the inward flange 712*d* of the internal cylinder 712.

The pen main body 713 is forced by the coil spring 714 in a direction (downward in FIGS. 15A and 15B) of making the pen tip 713*b* protrude from the opening 712*b* of the internal cylinder 712.

Since the pen main body 713 is forced downward also by its own weight, the coil spring 714 which applies a very slight elastic force is enough.

A coil spring 715 is wound around the outer circumference of the internal cylinder 712.

An end of the coil spring 715 contacts the upper surface of the inward flange 711*d* formed at the lower opening 711*b* of the external cylinder 711, and the other end contacts the lower surface of the outward flange 712*e* of the internal cylinder 712.

The internal cylinder 712 is forced by the coil spring 715 in a direction (upward in FIGS. 15A and 15B) of contacting the lower surface of the inward flange 711*c* formed at the upper opening 711*a* of the external cylinder 711.

As shown in FIG. 14B, the pen 71 is located at a position where the end portion of the shaft 712*a* provided at the internal cylinder 712 faces the concave portion 742*a* formed at the lower end portion of the plunger 742 when the pen holding unit 721 holding the pen 71 is located below the pen lifting mechanism 74.

Figure 16A:
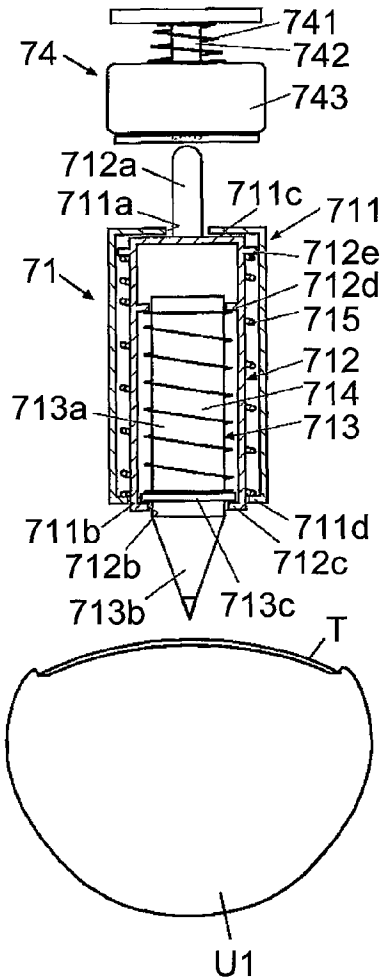
FIG. 16A is a sectional view of the pen in a non-drawing state.
Figure 16B:
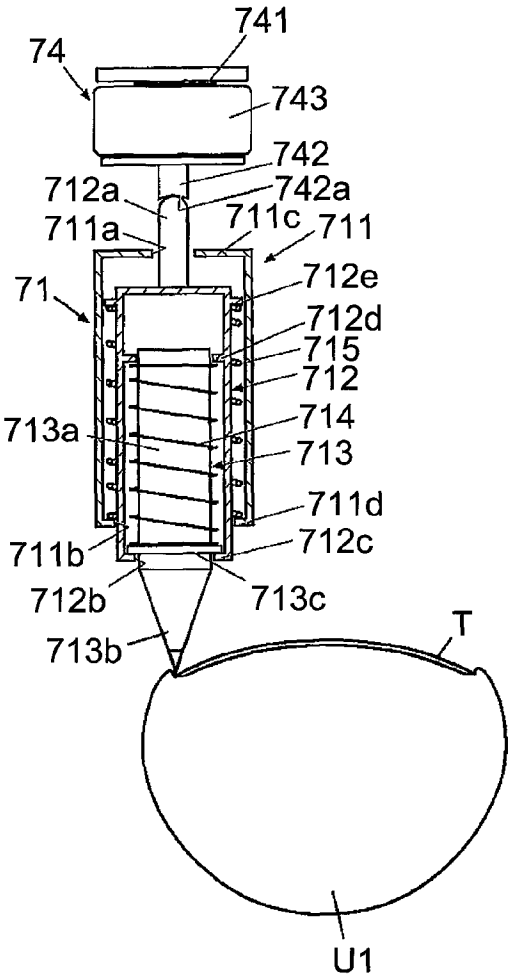
FIG. 16B is a sectional view of the pen drawing on a lower portion of the nail.
Figure 16C:
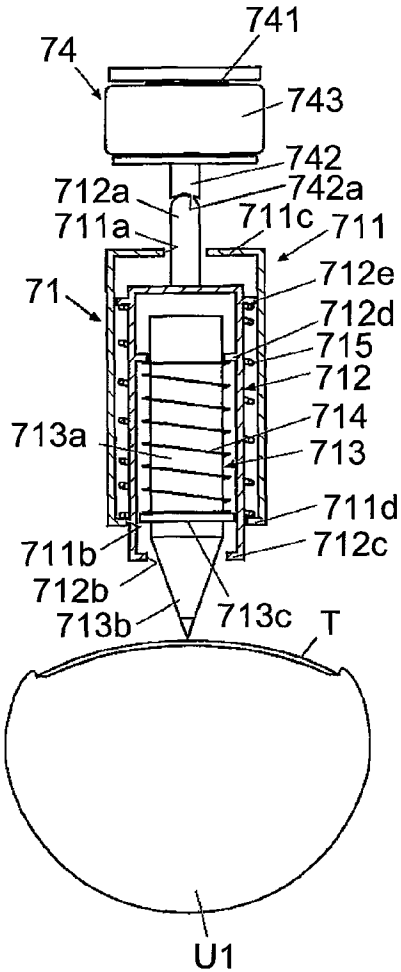
FIG. 16C is a sectional view of the pen drawing on a higher portion of the nail.

FIGS. 16A to 16C show relationships between the operation of the pen lifting mechanism 74 and the vertical movement of the pen 71.

In the non-drawing state, as shown in FIG. 16A, the plunger 742 of the pen lifting mechanism 74 does not contact the shaft 712*a* of the pen 71. At that time, the internal cylinder 712 of the pen 71 is lifted upward by the elastic force of the coil spring 715 so that the pen tip 713*b* does not protrude downward.

On the other hand, in the drawing state, the plunger 742 is pressed down by the solenoid 743 of the pen lifting mechanism 74 being operated.

Thus, as shown in FIGS. 16B and 16C, the one end of the plunger 742 contacts the shaft 712*a* of the pen 71, and presses the internal cylinder 712 downward against the elastic force of the spring 741. As a result, the pen tip 713*b* contacts the surface of the nail T and such like.

The pen main body 713 is forced downward by the coil spring 714 and by the pen tip 713*b* being pressed by an appropriate force on the surface of the nail T and such like, drawing becomes possible.

Since the elastic force of the coil spring 714 is slight, as shown in FIG. 16C, the pen main body 713 is lifted up by the surface of the nail T and such like against the elastic force of the coil spring 714 when the surface of the nail T and such like is high.

In such way, the pen main body 713 is configured so as to be movable in the Z direction (that is, vertical direction shown in FIG. 16C, for example) orthogonal to the X-Y plane in accordance with the surface shape of the nail T and such like.

The nail print apparatus 1 of the embodiment includes a control device which is nearly same as that of the first embodiment.

Similarly to the first embodiment, the drawing control unit 815 of the embodiment controls the drive of the X-direction movement motor 46 which moves the drawing head 70 in the X direction and the Y-direction movement motor 48 which moves the drawing head 70 in the Y direction, and in addition, controls the operation of the stepping motor 731 of the carriage rotation mechanism 73 which rotates the pen carriage 72 of the drawing head 70 and the solenoid 743 of the pen lifting mechanism 74 which vertically moves the pen 71 held by the pen carriage 72.

In the embodiment, the reading result of the reference index 725 by the index reading unit 734 is output to the drawing control unit 815. The drawing control unit 815 performs initialization as one rotation of the pen carriage 72 every time the reference index 725 is read out by the index reading unit 734, and gains the rotation amount of the pen carriage 72 as a shift amount from the reference position of rotation of the pen carriage 72 by the movement amount from the reference index 725 which is read out.

The drawing control unit 815 controls the drive of the stepping motor 731 according to the rotation amount of the pen carriage 72, and rotates the pen carriage 72 until the pen 71 necessary for drawing is moved to the predetermined position (that is, position where the pen lifting mechanism 74 is provided).

In a case where a motor formed so as to be rotatable forward and backward is used as the stepping motor 731, the pen 71 can be rapidly set by rotating the pen 71 necessary for drawing in the direction requiring less rotation amount to move to the predetermined position, for example.

Since the other configurations are similar to those of the first embodiment, the explanation thereof is omitted by providing same reference numerals to the same members.

Next, an operation and using method of the nail print apparatus 1 in the embodiment will be described.

When performing drawing by the nail print apparatus 1, the user turns on the power switch to activate the control device 80, first.

The display control unit 814 makes the display unit 26 display a design selection screen.

The user operates the operation buttons 251 and such like of the operation unit 25 and selects a desired nail design among a plurality of nail designs displayed on the design selection screen. Thus, a selection instruction signal is output from the operation unit 25 and the nail design to be drawn on the nail T is selected.

When the nail design is selected, the control unit 81 makes the display unit 26 display an instruction screen (that is, indicating the color and ink of the pen 71 to be set and the pen holding unit 721 to set in the pen 71) instructing setting of the pen 71 necessary to draw the selected nail design in a predetermined pen hooding unit 721 of the pen carriage 72 of the drawing head 70.

The configuration may be such that the control unit 81 can read out the type of pen 71 to be set in and the pen holding unit 721 to set in the pen 71 by a barcode or such like. In such case, nail designs which can be drawn by the pen 71 set in the pen holding unit 721 of the pen carriage 72 may be displayed on the design selection screen of the display unit 26 so that the user can select a nail design among them.

Then, the user inserts the printing finger U1 into the finger receiving unit 31 and inserts the non-printing fingers U2 into the finger resting unit 32 to fix the printing finger U1, and then operates the drawing switch.

When an instruction is input from the drawing switch, before starting the drawing operation, the photographing control unit 811 controls the photographing unit 50 first to photograph the printing finger U1 by the camera 51 while illuminating the printing finger U1 with the lights 52.

Thus, the photographing control unit 811 obtains an image of the nail T of the printing finger U1 inserted into the finger receiving unit 31.

Next, the nail information detecting unit 812 detects (calculates) the outline (nail shape and size) of the nail T, the nail position (including horizontal and vertical position of the nail T) and the nail curvature on the basis of the image of the nail T.

When the shape of the nail T, the position of the nail T and the curvature of the nail T are detected by the nail information detecting unit 812, the drawing data generation unit 813 performs the fitting process of the image data of the nail design into the nail T on the basis of the nail information. The drawing data generation unit 813 performs curved surface correction for the image data of the nail design on the basis of the nail information. Thereby, the drawing data is generated.

The drawing control unit 815 moves the drawing unit 7 to the pen test writing unit 61 to perform test writing of drawing a predetermined figure such as "o" on the drawing medium.

When the drawing data is generated and the test writing is also completed, the drawing control unit 815 outputs the drawing data to the drawing unit 7 and makes the drawing head 70 perform drawing on the basis of the drawing data.

Specifically, first, the drawing control unit 815 gains the rotation amount of the pen carriage 72 from the reading result of the reference index 725 by the index reading unit 734.

In accordance with the rotation amount of the pen carriage 72, the drawing control unit 815 controls the drive of the stepping motor 731 to rotate the pen carriage 72 until the pen 71 necessary for the drawing is moved to the position where the pen lifting mechanism is provided.

Furthermore, the drawing head 70 is appropriately moved in the X direction and Y direction to the drawing position and the solenoid 743 is operated to press the pen tip 713*b* of the pen 71 against the surface of the nail T.

At that time, the pen tip 713*b* is forced downward by an appropriate pressing force of the coil spring 714, and performs drawing on the surface of the nail T while moving up and down in accordance with the surface shape of the nail T.

In a case where drawing is performed on nails T of a plurality of fingers, after the drawing process is finished for a nail T of a finger, the finger of the nail T on which drawing has been performed is removed from the finger receiving unit 31, a finger of a nail T to perform drawing next is inserted into the finger receiving unit 31 as the printing finger U1, the nail image of the nail T is obtained, and the above process is repeated.

When replacing the pen 71, the drawing control unit 815 moves the drawing head 70 to a position corresponding to the pen replacement cover 23 and rotates the pen carriage 72 until the pen 71 to be replaced comes to the position corresponding to the pen replacement cover 23.

By the user opening the pen replacement cover 23 in this state, the pen 71 can be removed and replaced.

Figure 17A:
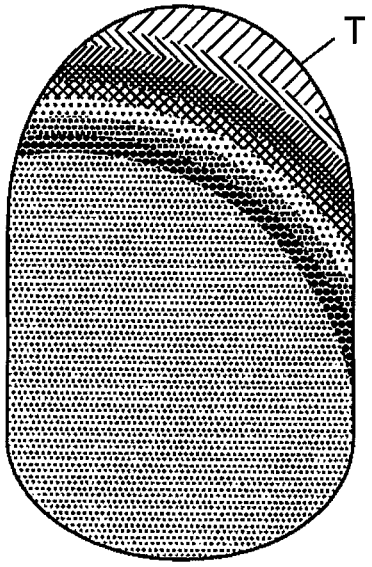
FIGS. 17A and 17B are nail plan views which show drawing examples by the nail print apparatus in the second embodiment.
Figure 17B:
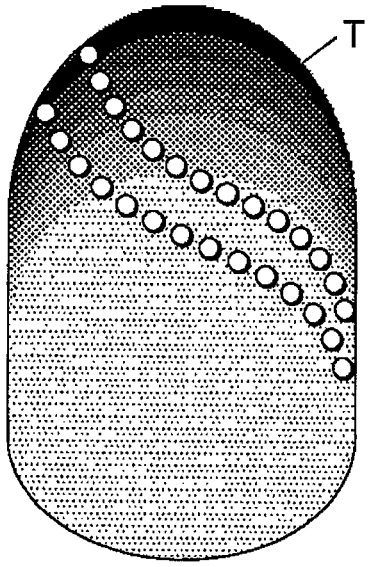

FIGS. 17A and 17B show examples of nail designs which can be drawn on the nail T by the nail print apparatus 1 in the embodiment.

In the nail print apparatus of the embodiment, as mentioned above, a plurality of types (eight types at most in the embodiment) of the pens 71 can be held at the same time to perform drawing. Thus, it is possible to easily draw even a complicated and delicate design which requires many colors such as a rainbow pattern requiring ink of seven colors as shown in FIG. 17A and a gradation pattern requiring a plurality of inks which have a gradation of density, for example.

Since the embodiment is similar to the first embodiment in the other respects, the explanation thereof is omitted.

As described above, according to the embodiment, the following effects can be obtained in addition to the same effects as the first embodiment.

That is, according to the nail print apparatus 1 of the embodiment, since a plurality (eight in the embodiment) of pen holding units 721 are included, the nail print apparatus 1 can hold more types of pens 71 at a time.

Thus, it is possible to draw complicated nail designs formed of many colors, and in addition, it is also possible to meet user's request to apply under coat and top coat in addition to a picture by the nail print apparatus 1 by making the pen holding units 721 hold a pen including white ink, a pen having transparent gel ink and such like.

That is, as in the embodiment, for example, in a case where the nail print apparatus 1 includes eight pen holding units 721, even when the nail print apparatus 1 includes pens 71 which perform drawing by inks for under coat and top coat, six types of pens 71 can also be set in the pen carriage 72 in addition to the above pens 71. Thus, it is possible to draw nail designs of sufficiently varied pictures.

In the embodiment, the pen carriage 72 to set the pens 71 is a rotation type. Thus, even when an increasing number of pens 71 can be set in the pen carriage 72, a single pen lifting mechanism 74 for moving the pens 71 up and down is enough. Thus, the number itself of solenoids necessary for the operation is less than that of the first embodiment.

Thus, the apparatus needs not be large and nail designs which can be drawn can be diversified.

Though the embodiments of the present invention have been described above, it goes without saying that the present invention is not limited to the embodiments and various changes can be made within the scope of the invention.

For example, the second embodiment has been described by taking, as an example, a case where the coil spring 714 is wound around the outer circumference of the pen main body 713. However, the coil spring 714 may not be included. The pen main body 713 is forced downward also by its own weight, and can obtain an appropriate pressing force which enables drawing on the surface of the nail T and such like only by the elastic force of its own weight without including the coil spring 714 when the pen main body 713 has a certain level of weight.

In the configuration of the first embodiment, a spring which forces the pen 41 downward may be provided to enhance the writing pressure.

The second embodiment has been described by taking, as an example, a case where the end portion of the shaft 712*a* provided at the internal cylinder 712 is in a hemisphere shape or a spindle shape and a concave portion 742*a* is formed at the lower end of the plunger 742. However, shapes of the end portion of the shaft 712*a* and the plunger 742 are not limited to this. For example, the configuration may be such that the lower end of the plunger 742 is in a hemisphere shape, a spindle shape or such like and a concave portion to receive this is formed at the end portion of the shaft 712*a*.

The second embodiment has been described by taking, as an example, a case where a stepping motor 731 is used as a drive unit of the carriage rotation mechanism 73 which rotates the pen carriage 72 of the drawing head 70. However, the configuration of the carriage rotation mechanism 73 is not limited to this.

Figure 18A:
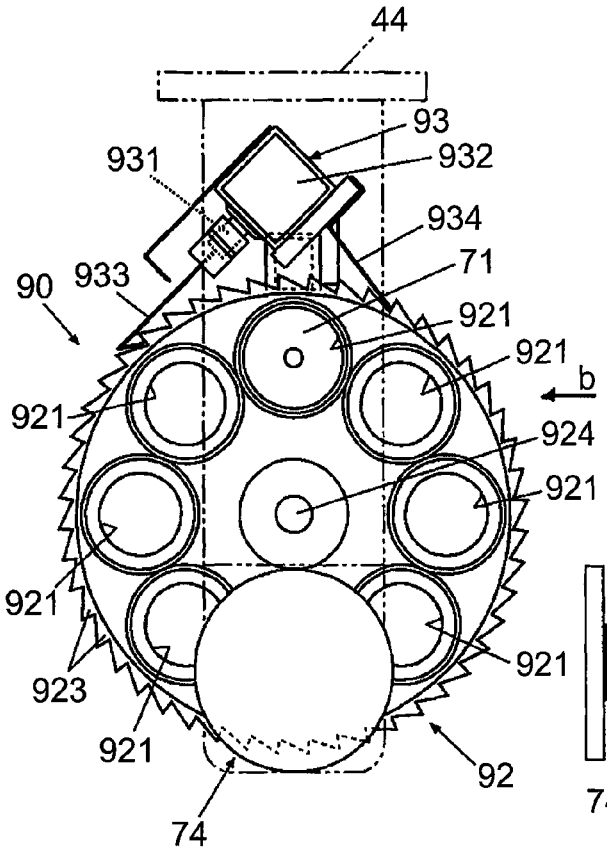
FIG. 18A is an enlarged top view of a drawing head in a modification example of the second embodiment.
Figure 18B:
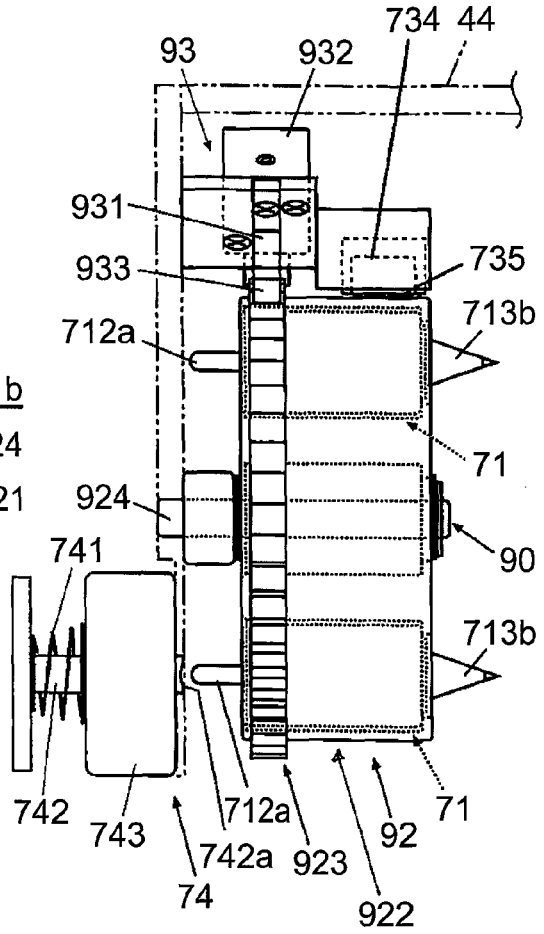
FIG. 18B is a top surface view of the drawing head of FIG. 18A seen from the arrow b direction.

For example, as shown in FIGS. 18A and 18B, a carriage rotation mechanism 93 which rotates a pen carriage 92 of a drawing head 90 may be configured by a ratchet mechanism, a solenoid and such like. In this case, specifically, a gear 923 is provided around the outer circumference surface of the carriage main body 922 of the pen carriage 92, and the carriage rotation mechanism 93 is configured by including a solenoid 932 which moves a plunger 931 back and forth, a tab portion 933 which is joined to the plunger 931 and such like. Then, by the operation of the solenoid 932, the tab portion 933 locks the gear 923 and rotates the pen carriage 92 in a predetermined direction (clockwise direction in FIG. 18A).

In such case, as shown in FIG. 18A, it is preferable to prevent the pen carriage 92 from rotating backward by providing a non-return spring 934 to the carriage rotation mechanism 93.

Also in this case, the reference index 725 for indicating the reference position of rotation of the pen carriage 92 is provided at a predetermined position (the position corresponding to a predetermined pen holding unit 921, for example) on the outer circumferential surface of the carriage main body 922, and by the index reading unit 734 such as a photo reflector reading out the reference index 725, the reference position and rotation amount of the rotation of pen carriage 92 can be gained.

The configuration of the carriage rotation mechanism is not limited to this, and a servomotor or a DC motor may also be used as well as the above examples, for example.

In such case, a sensor and such like for gaining the reference position of rotation of the pen carriage is appropriately provided.

An identification index such as a barcode indicating the type may be provided to the pen so that the type of pen 71 held by each of the pen carriages 43 in the first embodiment and the type of pen 91 held by each of the pen holding units 721 in the second embodiment can be identified by detecting the identification index.

In such case, the user only needs to specify the pen to be used for drawing on the basis of the identification index and move the pen to the drawing position to perform drawing. Thus, it is not necessary to provide a configuration for gaining the reference position of rotation of the pen carriage as shown in the second embodiment, and such like.

In the above embodiments, a configuration which uses a solenoid as the pen lifting mechanism to move the pen up and down is illustrated. However, the configuration of the pen lifting mechanism is not limited to this.

For example, the pen lifting mechanism may be configured by including a stepping motor, a DC motor, a motor or a ball screw.

The above embodiments show an example where the X-direction movement stage 45 and the Y-direction movement stage 47 for moving the drawing head are configured by the combination of the X-direction movement motor 46 and the Y-direction movement motor 48 which are stepping motors, and a ball screw and a guide which are not shown in the drawings. However, the configuration for moving the drawing head is not limited to this.

For example, the configuration may use a mechanism which is configured by including a shaft, a guide and a wire as used in conventional inexpensive printers. The configuration may also use a servomotor or such like.

Though a pen which draws by ink is illustrated as a pen in the above embodiments, the pen set in the drawing head is not limited to the pen which draws by ink.

For example, the pen may contain liquid glue which is colorless or colored transparent so that the liquid glue can be applied to the nail. In this case, after setting the pen which contains the liquid glue in the drawing head and applying the liquid glue to the nail by using the pen, by sprinkling powder lame and such like or attaching rhinestones and such like before the glue gets dry, more gorgeous nail designs can be achieved.

A pen containing perfumed liquid or such like may be set in the drawing head and used for drawing so that the user can enjoy fragrant nail prints.

In the embodiments, a case where a plurality of (four or eight, for example) pens can be set in the drawing head at the same time is illustrated. However, the configuration may be such that only a single pen can be set in the drawing head and the user appropriately replaces the pen by hand as needed. In such case, the configuration of the nail print apparatus can be simplified and manufactured at low cost.

A mechanism which automatically replaces the pen set in the drawing head may be mounted. In such case, a plurality of pens are held in a standby space, and a pen is automatically selected from the standby space and set in the drawing head, for example. In such configuration, the number of pens which can be set in the apparatus can be more increased.

In the embodiments, a case where the drawing medium 61*a* used for test writing of pen is a single sheet of paper is illustrated. However, the drawing medium 61*a* is not limited to the single sheet of paper. A roll of paper may be used as the drawing medium 61*a*. In such case, a medium feeding mechanism which unrolls the drawing medium 61*a* to feed a sheet automatically or manually is provided. Furthermore, in a case where the drawing medium 61*a* is made of a roll of paper, a medium attachment port for attaching and detaching the roll of drawing medium 61*a* is provided instead of the medium inserting port 24.

In the embodiments, a case where the drawing data generation unit 813 performs curved surface correction for the image data of nail design and generates the drawing data is illustrated. However, generation of drawing data by the drawing data generation unit 813 is not an essential configuration element of the present invention.

For example, without generating the drawing data separately, the drawing control unit 815 appropriately converts the image data of nail design by LUT (Lookup table) and outputs the converted data to the drawing head to control the drawing so as to be fitted to the nail shape.

In the embodiments, a case where nail information such as the shape of nail T is detected and the drawing data is generated on the basis of the detected nail information is illustrated. However, detecting the nail information is not an essential configuration element of the present invention.

For example, in a case where extracting the outline of the nail T is not essential for drawing as in a case of drawing a one-point pattern around the central portion of the nail T, the shape of the nail T needs not be accurately recognized and drawing can be performed without detecting the nail information.

The photographing device is not limited to the camera 51 which photographs a still image, and may be able to photograph a moving image. In such case, the moving image is photographed by the camera, an image of the upper surface of the nail T is appropriately cut out from the photographed moving image, and the image is used for detecting the nail information.

In the embodiments, a case where the nail image storage area 821, the nail information storage area 822 and the nail design storage area 823 are provided in the storage unit 82 of the control device 80 is illustrated. However, the present invention is not limited to the above case of providing the nail image storage area 821, the nail information storage area 822 and the nail design storage area 823 in the storage unit 82 of the control device 80, and another storage unit may be separately provided.

In the embodiments, a finger is inserted into the nail print apparatus 1 one by one and drawing is performed in order as an example. However, the present invention can also be applied to an apparatus which can perform drawing continuously on a plurality of fingers without removing and inserting each of the fingers.

For example, by increasing the range of drawing by broadening the movement range of the pen, drawing can be performed continuously on the fingers in a state where the plurality of printing fingers U1 are inserted at a time.

Though several embodiments of the present invention have been described above, the scope of the present invention is not limited to the above embodiments, and includes the scope of inventions, which is described in the scope of claims, and the scope equivalent thereof.

What is claimed is:

1. A nail print apparatus, comprising:

a placement surface on which a drawing target is placed, the drawing target having a curved shape along a width direction of the drawing target, wherein the drawing target is a nail of a finger or a toe;

a drawing head in which at least one drawing tool is set, the drawing tool having a tip portion that contacts with a surface of the drawing target and performs drawing of a nail design on the surface of the drawing target;

a head drive unit which moves the drawing head; and a test writing unit in which test writing is performed by the drawing tool on a drawing medium provided at a position different from a position of the drawing target;

wherein:

the drawing medium is a member different from the drawing target;

the head drive unit is controlled to move the drawing tool along the placement surface via the drawing head when performing the drawing;

the drawing tool is movable in accordance with the curved shape of the drawing target when performing the drawing; and the head drive unit is controlled to perform the test writing by moving the drawing tool via the drawing head and drawing a predetermined figure on the drawing medium of the test writing unit with the drawing tool before performing the drawing of the nail design on the surface of the drawing target.

2. The nail print apparatus according to claim 1, wherein the drawing head includes a drawing tool lifting mechanism which sets the drawing tool to a first state where the tip portion does not contact with the surface of the drawing target when the drawing is not performed and sets the drawing tool to a second state where the tip portion contacts with the surface of the drawing target when the drawing is performed.

3. The nail print apparatus according to claim 2, wherein the drawing tool includes:

a shaft, the tip portion of the drawing tool being provided at one end of the shaft; and a flange portion which is provided at the other end of the shaft, and wherein the drawing tool lifting mechanism includes:

an arm that has, at an end portion, a holding unit through which the shaft is inserted and which contacts and supports the flange portion; and a height change mechanism which sets a height of the holding unit of the arm to one of a first position where the drawing tool is set in the first state and a second position where the drawing tool is set in the second state.

4. The nail print apparatus according to claim 3, wherein:

a plurality of the drawing tools and a plurality of the drawing tool lifting mechanisms are provided;

the drawing head includes a plurality of carriages each of which is adapted to hold a respective one of the plurality of drawing tools, and each of the plurality of carriages is provided with (i) a holder in which the respective one of the plurality of drawing tools is insertable and holdable, and (ii) a respective one of the plurality of drawing tool lifting mechanisms.

5. The nail print apparatus according to claim 2, wherein:

the drawing tool includes a first elastic member which forces the tip portion in a first direction where the tip portion does not contact with the surface of the drawing target;

when the drawing is not performed, the drawing tool lifting mechanism sets the drawing tool to the first state by not contacting with the drawing tool; and when the drawing is performed, the drawing tool lifting mechanism sets the drawing tool to the second state by pressing the drawing tool, against an elastic force of the first elastic member, in a direction where the tip portion contacts with the surface of the drawing target.

6. The nail print apparatus according to claim 5, wherein the drawing tool further includes a second elastic member which forces the tip portion in a second direction opposite to the first direction where the tip portion contacts with the surface of the drawing target, and when the drawing is performed, the tip portion contacts with the surface of the drawing target by a combined load of a weight of the drawing tool itself and an elastic force of the second elastic member.

7. The nail print apparatus according to claim 6, wherein the drawing tool further includes:

an external cylinder which has a first end and a second end and is formed in a cylinder shape;

an internal cylinder which has a first end and a second end, a part of the internal cylinder being contained in the external cylinder, and a part of the internal cylinder being exposed from an opening of the second end of the external cylinder;

a main body which has a first end and a second end, a part of the main body being contained in the internal cylinder, the second end of the main body being exposed from an opening of the second end of the internal cylinder, the main body having a flange portion which is larger than the opening of the second end of the internal cylinder and which is provided at a portion of the main body that is contained in the internal cylinder at a side of the second end of the main body, and the tip portion being provided at the second end of the main body; and a shaft portion which is provided at the first end of the internal cylinder, a part of the shaft portion being exposed from the first end of the external cylinder, and wherein:

the first elastic member is provided between an internal circumference of the external cylinder and an outer circumference of the internal cylinder, and forces the internal cylinder in a direction toward the first end of the external cylinder;

the second elastic member is provided between an internal circumference of the internal cylinder and an outer circumference of the main body, and forces the main body in a direction toward the second end of the internal cylinder;

the drawing tool lifting mechanism includes a plunger which operates so as to be in a protruding state of protruding in the second direction and in a non-protruding state of not protruding;

when the plunger is in the non-protruding state, the plunger does not contact with the shaft portion of the internal cylinder and sets the drawing tool to the first state; and when the plunger is in the protruding state, a first end of the plunger contacts with the shaft portion of the internal cylinder, presses the internal cylinder in the second direction of the external cylinder, and sets the drawing tool to the second state.

8. The nail print apparatus according to claim 7, wherein the drawing head further includes a rotary carriage which is capable of holding a plurality of the drawing tools and selects a specific drawing tool to be used in the drawing; and wherein the drawing tool lifting mechanism is provided at a position corresponding to the specific drawing tool.

9. The nail print apparatus according to claim 1, wherein the drawing tool includes a containing unit which contains liquid material and applies the liquid material to the surface of the drawing target when the tip portion contacts with the surface of the drawing target.

10. The nail print apparatus according to claim 9, wherein the liquid material is ink for forming the nail design.

11. The nail print apparatus according to claim 9, wherein the liquid material is liquid glue.

12. The nail print apparatus according to claim 1, further comprising:

a photographing device which photographs the nail of the drawing target and obtains a nail image; and a nail information detecting unit which detects at least one of a nail shape and a nail position as nail information based on the nail image obtained by the photographing device, and wherein a control unit controls the drawing head to perform the drawing on the nail based on the nail information detected by the nail information detecting unit.

13. The nail print apparatus according to claim 1, wherein:

the test writing unit with the drawing medium;

the drawing medium comprises a sheet of paper; and the test writing unit is provided within a movable range in which the drawing head is movable by the head drive unit.

14. The nail print apparatus according to claim 1, further comprising a medium inserting port through which the drawing medium is replaceable.

* * * * *

UNITED STATES PATENT AND TRADEMARK OFFICE

CERTIFICATE OF CORRECTION

PATENT NO. : 9,056,491 B2
APPLICATION NO. : 14/185767
DATED : June 16, 2015
INVENTOR(S) : Bitoh It is certified that error appears in the above-identified patent and that said Letters Patent is hereby corrected as shown below:

In the claims

Column 27, line 9, claim 13, line 2, delete "unit" and insert --unit is provided--.

Signed and Sealed this
Seventeenth Day of May, 2016

Michelle K. Lee

Michelle K. Lee
*Director of the United States Patent and Trademark Office*